US008702443B2

(12) United States Patent
Kajiura et al.

(10) Patent No.: US 8,702,443 B2
(45) Date of Patent: Apr. 22, 2014

(54) ELECTRICAL TERMINAL HAVING CRIMP MEMBERS WITH DIFFERENT NUMBER OF CRIMP TEETH

(75) Inventors: Motomu Kajiura, Tokyo (JP); Yasutoshi Kameda, Kisarazu (JP); Jeffery Garvais, Beaverton, OR (US)

(73) Assignees: FCI Americas Technology LLC, Carson City, NV (US); FCI, Guyancourt (FR)

( * ) Notice: Subject to any disclaimer, the term of this patent is extended or adjusted under 35 U.S.C. 154(b) by 18 days.

(21) Appl. No.: 13/486,068

(22) Filed: Jun. 1, 2012

(65) Prior Publication Data

US 2012/0309224 A1 Dec. 6, 2012

Related U.S. Application Data

(60) Provisional application No. 61/492,339, filed on Jun. 1, 2011, provisional application No. 61/492,350, filed on Jun. 1, 2011.

(51) Int. Cl.
*H01R 4/24* (2006.01)

(52) U.S. Cl.
USPC ..... 439/422

(58) Field of Classification Search
USPC ..... 439/421–424, 399, 404
See application file for complete search history.

(56) References Cited

U.S. PATENT DOCUMENTS

| | | | | |
|---|---|---|---|---|
| 3,612,747 A | | 10/1971 | Shlesinger, Jr. | |
| D227,767 S | | 7/1973 | Gillespie | |
| 4,082,402 A | * | 4/1978 | Kinkaid et al. | 439/422 |
| 4,171,858 A | | 10/1979 | Knowles et al. | |
| 4,371,225 A | | 2/1983 | Narozny | |
| 4,560,226 A | | 12/1985 | Dennis | |
| 4,564,253 A | | 1/1986 | Sinclair | |
| 4,749,368 A | | 6/1988 | Mouissie | |
| 4,784,623 A | * | 11/1988 | Beck, Jr. | 439/872 |
| 4,832,620 A | * | 5/1989 | Yamamoto | 439/422 |
| 5,567,545 A | | 10/1996 | Murakami | |
| 5,631,098 A | | 5/1997 | Suzuki | |
| D408,353 S | | 4/1999 | Yoshiura | |
| D409,143 S | | 5/1999 | Yoshiura | |
| D410,226 S | | 5/1999 | Yoshiura | |
| 6,083,059 A | | 7/2000 | Kuan | |
| 6,129,168 A | | 10/2000 | Lotito et al. | |

(Continued)

FOREIGN PATENT DOCUMENTS

| | | |
|---|---|---|
| TW | D116895 | 5/2007 |
| TW | D126581 | 12/2008 |
| TW | D127913 | 3/2009 |
| TW | D134355 | 4/2010 |

OTHER PUBLICATIONS

U.S. Appl. No. 13/226,864, filed Sep. 7, 2011, de Bruijn et al.
U.S. Appl. No. 29/369,322, filed Sep. 7, 2010, de Bruijn et al.

(Continued)

*Primary Examiner* — Chandrika Prasad
(74) *Attorney, Agent, or Firm* — Baker & Hostetler LLP

(57) ABSTRACT

In accordance with one embodiment, an electrical connector includes a connector housing, and at least one electrical terminal supported by the connector housing. The electrical terminal defines a mating portion and a mounting portion, the mounting portion carrying a pair of crimp members having crimp teeth configured to pierce through a flex cable when crimped so as to mount the flex cable to the mounting portion of the electrical terminal.

19 Claims, 17 Drawing Sheets

(56) References Cited

U.S. PATENT DOCUMENTS

| | | | | |
|---|---|---|---|---|
| 6,146,179 | A | 11/2000 | Denny et al. | |
| D447,122 | S | 8/2001 | Harasawa et al. | |
| 6,309,241 | B2 | 10/2001 | Nagai | |
| 6,315,621 | B1 | 11/2001 | Natori et al. | |
| 6,375,492 | B1 | 4/2002 | Hio | |
| D473,192 | S | 4/2003 | Ouchi et al. | |
| D481,996 | S | 11/2003 | Kihira et al. | |
| D485,807 | S | 1/2004 | Kao et al. | |
| 6,755,679 | B2 | 6/2004 | Godefroy et al. | |
| 6,835,089 | B2 | 12/2004 | Hayes et al. | |
| 6,932,382 | B2 | 8/2005 | Hayes et al. | |
| 6,933,445 | B1 * | 8/2005 | Duesterhoeft et al. | 174/84 C |
| 6,951,488 | B2 | 10/2005 | Hsieh | |
| 6,953,356 | B2 | 10/2005 | Hisamatsu et al. | |
| 7,001,205 | B2 | 2/2006 | Godefroy et al. | |
| D528,985 | S | 9/2006 | Peng | |
| 7,112,103 | B2 | 9/2006 | Zhang et al. | |
| D529,443 | S | 10/2006 | Chien | |
| D530,679 | S | 10/2006 | Li et al. | |
| D538,228 | S | 3/2007 | Wang et al. | |
| D555,093 | S | 11/2007 | Chien et al. | |
| D555,095 | S | 11/2007 | Ho | |
| D555,096 | S | 11/2007 | Peng | |
| D555,131 | S | 11/2007 | Kim et al. | |
| D556,131 | S | 11/2007 | Chien | |
| D556,135 | S | 11/2007 | Dwan et al. | |
| D559,180 | S | 1/2008 | Lai et al. | |
| 7,335,068 | B2 | 2/2008 | Dwan et al. | |
| 7,338,310 | B2 | 3/2008 | Kumakura | |
| D568,246 | S | 5/2008 | Wu et al. | |
| D568,248 | S | 5/2008 | Chen et al. | |
| D569,343 | S | 5/2008 | Hung et al. | |
| D569,801 | S | 5/2008 | Chuang | |
| D569,802 | S | 5/2008 | Long et al. | |
| D570,288 | S | 6/2008 | Ma et al. | |
| 7,445,518 | B2 | 11/2008 | Hild et al. | |
| D582,348 | S | 12/2008 | Shiu | |
| D584,231 | S | 1/2009 | Wu | |
| D584,237 | S | 1/2009 | Zhu | |
| D586,294 | S | 2/2009 | Lung | |
| D596,575 | S | 7/2009 | Chen et al. | |
| 7,556,503 | B2 | 7/2009 | Vinther | |
| 7,575,439 | B2 | 8/2009 | Chen et al. | |
| 7,585,192 | B1 | 9/2009 | Lai | |
| D601,970 | S | 10/2009 | Peng et al. | |
| D601,971 | S | 10/2009 | Chen et al. | |
| 7,607,952 | B2 | 10/2009 | Tai | |
| D603,795 | S | 11/2009 | Kono | |
| D605,137 | S | 12/2009 | Yu et al. | |
| D607,834 | S | 1/2010 | Huang | |
| D607,835 | S | 1/2010 | Huang | |
| D608,295 | S | 1/2010 | Huang | |
| 7,662,507 | B2 | 2/2010 | Schwendinger et al. | |
| D614,493 | S | 4/2010 | Creed et al. | |
| D614,507 | S | 4/2010 | Lukan et al. | |
| D614,583 | S | 4/2010 | Wang | |
| D615,493 | S | 5/2010 | Kalis | |
| D615,943 | S | 5/2010 | Kang et al. | |
| D618,173 | S | 6/2010 | Wang et al. | |
| D619,538 | S | 7/2010 | Peng | |
| D642,981 | S | 8/2011 | de Bruijn et al. | |
| D644,177 | S | 8/2011 | de Bruijn et al. | |
| D647,863 | S | 11/2011 | Su et al. | |
| D649,517 | S | 11/2011 | De Bruijn et al. | |
| D659,645 | S | 5/2012 | Kajiura et al. | |
| D659,646 | S | 5/2012 | Kajiura et al. | |
| D666,151 | S | 8/2012 | Liao | |
| D672,724 | S | 12/2012 | Kajiura et al. | |
| 8,382,509 | B2 * | 2/2013 | David et al. | 439/487 |
| 2002/0112985 | A1 | 8/2002 | Casses et al. | |
| 2004/0038121 | A1 | 2/2004 | Song et al. | |
| 2004/0137802 | A1 * | 7/2004 | Wendling et al. | 439/877 |
| 2005/0178577 | A1 * | 8/2005 | Duesterhoeft et al. | 174/84 C |
| 2005/0287865 | A1 | 12/2005 | Wang et al. | |
| 2006/0089018 | A1 | 4/2006 | Orita et al. | |
| 2007/0202737 | A1 | 8/2007 | Wei et al. | |
| 2007/0243458 | A1 | 10/2007 | Roehm et al. | |
| 2008/0193837 | A1 | 8/2008 | Lu | |
| 2009/0137136 | A1 | 5/2009 | Shen | |
| 2011/0300759 | A1 | 12/2011 | Ngo | |
| 2012/0058668 | A1 * | 3/2012 | De Bruijn et al. | 439/399 |
| 2012/0058669 | A1 * | 3/2012 | Bruijn et al. | 439/422 |
| 2012/0214347 | A1 | 8/2012 | Sass et al. | |
| 2012/0309225 | A1 * | 12/2012 | Kajiura et al. | 439/422 |

OTHER PUBLICATIONS

U.S. Appl. No. 29/369,327, filed Sep. 7, 2010, de Bruijn et al.
U.S. Appl. No. 29/369,333, filed Sep. 7, 2010, de Bruijn et al.
U.S. Appl. No. 29/384,323, filed Jan. 28, 2011, de Bruijn et al.
U.S. Appl. No. 29/384,325, filed Jan. 28, 2011, de Bruijn et al.
U.S. Appl. No. 29/393,268, filed Jun. 1, 2011, Kajiura et al.
U.S. Appl. No. 29/393,269, filed Jun. 1, 2011, Kameda et al.
U.S. Appl. No. 29/393,270, filed Jun. 1, 2011, Kajiura et al.
U.S. Appl. No. 29/393,276, filed Jun. 1, 2011, Kajiura et al.
U.S. Appl. No. 29/393,278, filed Jun. 1, 2011, Kameda et al.
U.S. Appl. No. 29/393,280, filed Jun. 1, 2011, Kajiura et al.
U.S. Appl. No. 29/393,281, filed Jun. 1, 2011, Kameda et al.
U.S. Appl. No. 29/393,282, filed Jun. 1, 2011, Kajiira et al.
U.S. Appl. No. 29/393,283, filed Jun. 1, 2011, Kameda et al.
U.S. Appl. No. 29/407,357, filed Nov. 28, 2011, de Bruijn et al.
U.S. Appl. No. 29/407,363, filed Nov. 28, 2011, Kajiira et al.
U.S. Appl. No. 29/407,370, filed Nov. 28, 2011, Kajiira et al.
Taiwan Patent Application No. 100306483: Allowance Decision dated Aug. 20, 2012 with Search Report dated Jul. 24, 2012, 8 pages.
Taiwan Patent Application No. 100306484: Allowance Decision dated Aug. 17, 2012 with Search Report dated Jul. 24, 2012, 8 pages.
Taiwan Patent Application No. 100306485: Allowance Decision dated Aug. 20, 2012 with Search Report dated Jul. 24, 2012, 8 pages.
Taiwan Patent Application No. 100306491: Allowance Decision dated Aug. 17, 2012 with Search Report dated Jul. 24, 2012, 8 pages.

* cited by examiner

ELECTRICAL TERMINAL HAVING CRIMP MEMBERS WITH DIFFERENT NUMBER OF CRIMP TEETH

CROSS-REFERENCE TO RELATED APPLICATIONS

This claims the benefit of U.S. provisional patent application Ser. No. 61/492,339 filed Jun. 1, 2011, the disclosure of which is hereby incorporated by reference as if set forth in its entirety herein.

The present application is related by subject matter to U.S. provisional patent application Ser. No. 61/492,350 filed Jun. 1, 2011, and is further related by subject matter to U.S. design patent Ser. Nos. 29/393,270 filed Jun. 1, 2011, 29/393,276 filed Jun. 1, 2011, 29/393,282 filed Jun. 1, 2011, 29/393,269 fled Jun. 1, 2011, 29/393,278 filed Jun. 1, 2011, 29/393,281 filed Jun. 1, 2011, and 29/393,283 filed Jun. 1, 2011.

TECHNICAL FIELD

The present disclosure relates to electrical connectors, and in particular relates to an electrical terminal including a crimp fitting.

BACKGROUND

Electrical connectors conventionally include a housing that retains a plurality of electrically conductive terminals that define opposed mounting ends and mating ends configured to be placed in electrical communication with respective first and second complementary electrical devices. For instance, flat flex cables are widely used to connect the first electrical device to the mounting end of an electrical connector. Accordingly, when the electrical connector is mated to the second electrical device, the first and second electrical devices are placed in electrical communication. Flat flex cables have found increasing use as a replacement for costly and, in particular, heavy-weight cable harnesses.

SUMMARY

In accordance with one embodiment, an electrical connector is configured to mount to a flex cable. The electrical connector can include a dielectric connector housing, and at least one electrical terminal supported by the connector housing. The at least one electrical terminal can define a mating portion and a mounting portion, the mounting portion including first and second crimp members spaced from each other along a length of the at least one electrical terminal. Each of the first and second crimp members can include a plurality of crimp teeth configured to pierce through a flex cable when crimped so as to mount the flex cable to the mounting portion. One of the first and second crimp members has a different number of crimp teeth than the other of the first and second crimp members.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION

Figure 1:
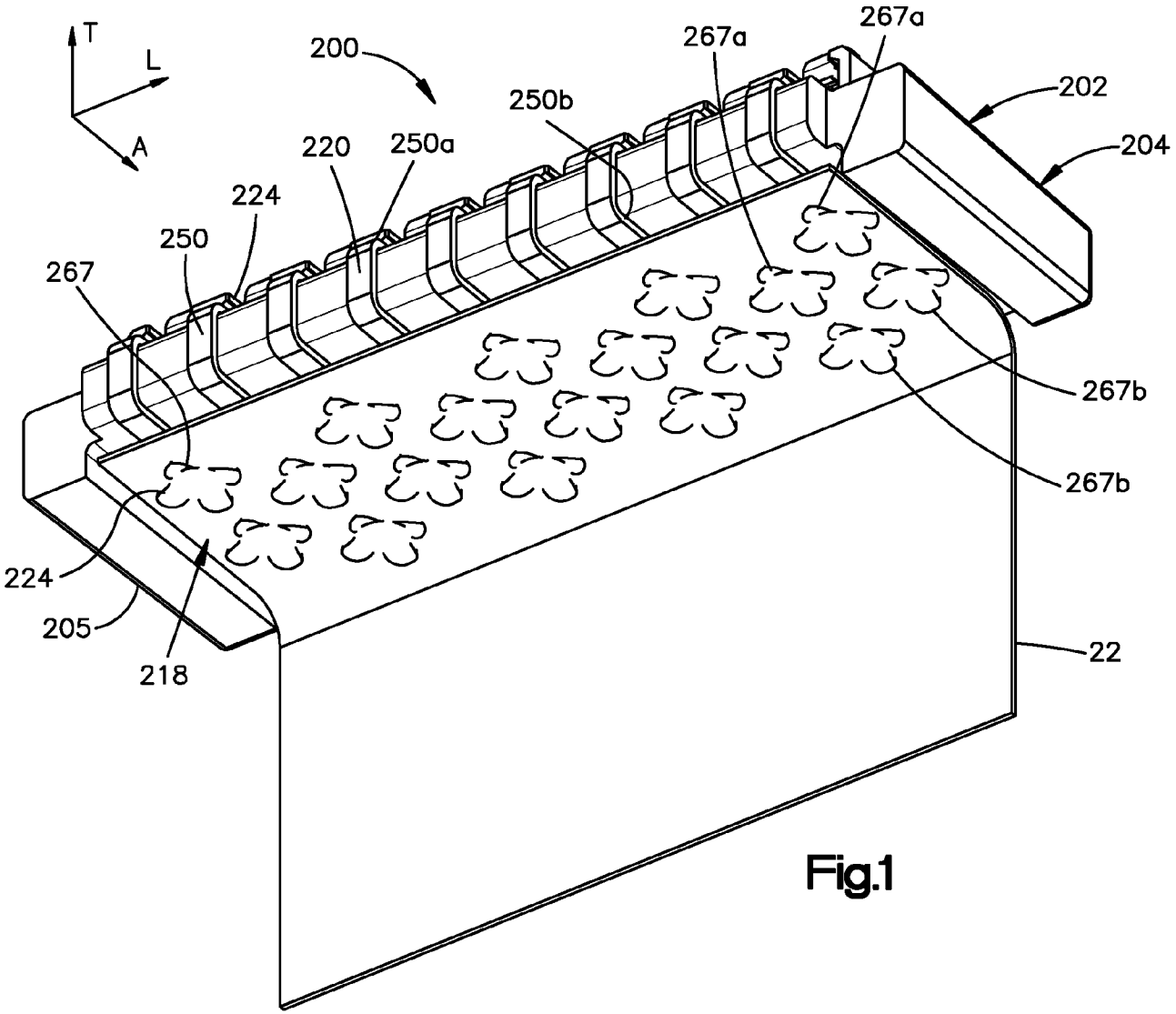
FIG. 1 is a perspective view of an electrical connector assembly constructed in accordance with one embodiment, including an electrical connector and a flexible printed circuit electrically connected to the electrical connector, the electrical connector including a connector housing and a plurality of electrical terminals supported by the connector housing.
Figure 2A:
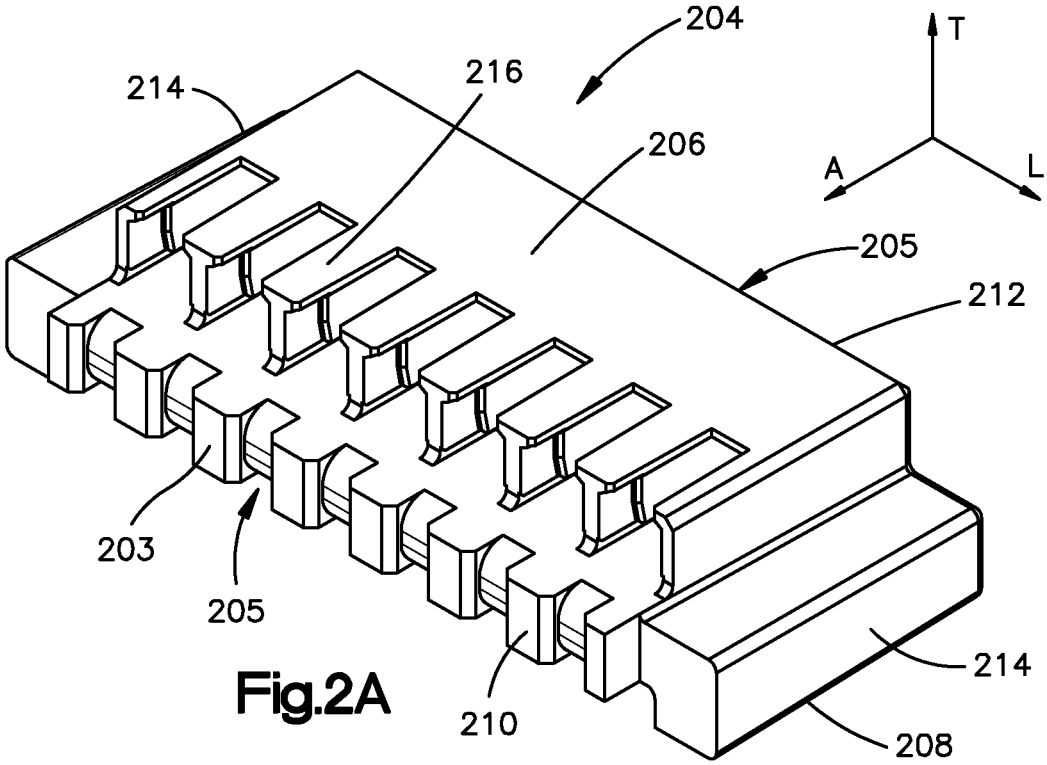
FIG. 2A is a perspective view of the connector housing as illustrated in FIG. 2A.
Figure 2B:
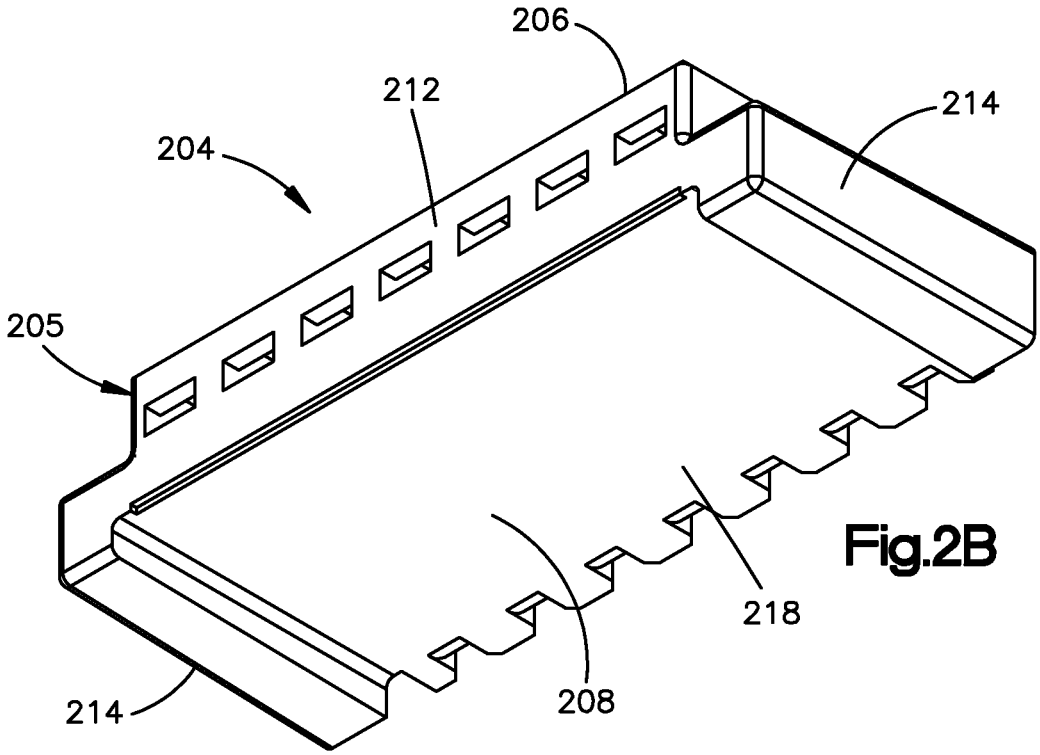
FIG. 2B is another perspective view of the connector housing as illustrated in FIG. 2B.
Figure 2C:
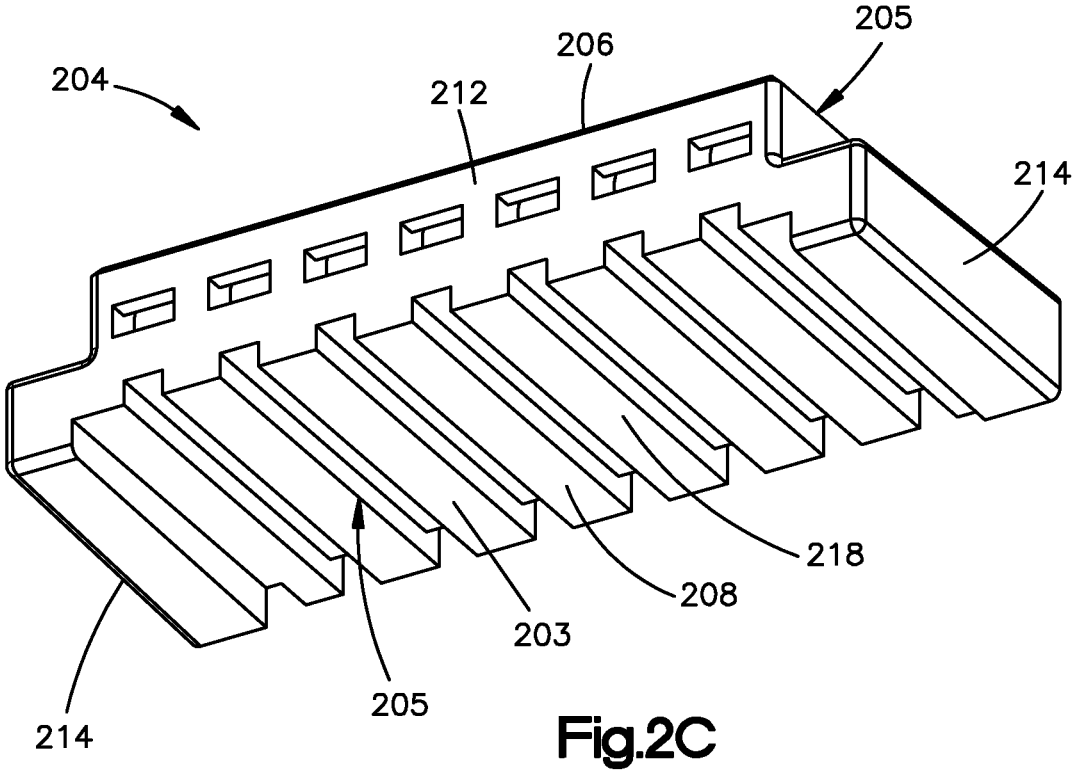
FIG. 2C is a perspective view of the connector housing similar to FIG. 3B, but showing ribs in accordance with an alternative embodiment.

Referring to FIG. 1A, an electrical connector assembly 200 includes an electrical connector 202 and a flat flex cable, also referred to as a flexible printed circuit (FPC) 22 that is configured to be mounted onto the electrical connector 202. The electrical connector 202 includes a connector housing 204 that is dielectric or electrically insulative. As also illustrated in FIGS. 2A-C, the connector housing 204 includes a substantially rectangular housing body 205 that defines a top end 206, an opposed bottom end 208, a front end 210, an opposed rear end 212, and opposed sides 214. A first one of the opposed first and second housing surfaces, for instance at the top end 206, is configured to mate with a complementary connector, and the opposed second housing surface, for instance at the bottom end 208, is configured to secure the flat flex cable 22. Thus, the connector housing 204 defines a mating interface 216 disposed proximate to the top end 206, and a mounting interface 218 disposed proximate to the bottom end 208. The mounting interface 218 is configured to operatively engage the flat flex cable 22, while the mating interface 216 is configured to operatively engage a second complementary electrical connector. The front end 210 of the connector housing 204 can be ribbed as illustrated in FIGS. 2A-B, or can be substantially flat as illustrated in FIGS. 3A-E.

The opposed sides 214 are spaced apart along a first or longitudinal direction L, the front end rear ends 210 and 212 are spaced apart along a second or lateral direction A that is substantially perpendicular with respect to the longitudinal direction L, and the top and bottom ends 206 and 208 are spaced apart along a third or transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the electrical connector 202 may vary during use. In accordance with the illustrated embodiment, the connector housing 204 is illustrated as elongate in the longitudinal direction.

It should be appreciated that the connector housing 204 can be constructed in accordance with any suitable embodiment as desired. For instance, as illustrated in FIG. 2B, the bottom end 208 of the connector housing 204 can be substantially flat and lie in a plane defined by longitudinal direction L and the lateral direction A. Alternatively, as illustrated in FIG. 2C, the bottom end 208 of the connector housing 204 can define ribs 203 that are spaced from each other along the longitudinal direction L and separated from each other by adjacent recesses 205. The alternating ribs 203 and recesses 205 can extend along the lateral direction from the front end 210 of the connector housing 204 to the rear end 212 of the connector housing 204. Further, as illustrated in FIGS. 2A-B, ribs 203 and recesses 205 can extend along at least a portion or all of the front end 210 of the connector housing 204. The recesses 205 at the front end 210 of the connector housing 204 are configured and sized to receive a portion of electrical terminals 200 that are mounted to the connector housing 204. Alternatively, the front end 210 of the connector housing can be substantially smooth as illustrated in FIGS. 3A-E.

Referring now to FIGS. 1 and 3A-4C, the electrical connector 202 includes a plurality of electrical terminals 220 that are electrically conductive and retained or otherwise supported by the connector housing 204. The electrical connector 202 can include any number of electrical terminals 220 as desired. The electrical terminals 220 each define a mating portion 222 that is configured to electrically connect, for instance removably electrically connect, to a complementary electrical terminal of the complementary electrical component that is mated with the electrical connector 202, and an opposed mounting portion 224 that is configured to electrically connect to the flat flex cable 22. The mating portion 222 is disposed proximate to the mating interface 216, and the opposed mounting portion 224 is disposed proximate to the mounting interface 218. In particular, the mating portions 222 extend substantially in the lateral direction A along the top end 206 and can extend out from the top end 206, and the mounting portions 224 of the electrical terminals 220 extend substantially in the lateral direction A along the bottom end 208 when the electrical terminals 220 are fully installed on the connector housing 204.

Each of the electrical terminals 220 can be configured as a battery terminal, and can include a terminal body that defines a mating portion 222 and a mounting portion 224, and an intermediate portion 250 connected between the mating portion 222 and the mounting portion 224. In accordance with the illustrated embodiment, the mating portion 222, the mounting portion 224, and the intermediate portion 250 are integral with each other. Furthermore, in accordance with the illustrated embodiment, when the electrical terminals 220 are fully installed on the connector housing, the mating portion 222 and the mounting portion 224 each extend from respective first and second spaced locations of the intermediate portion 250 along the same direction, such as rearward, such that the mating portion 222 and the mounting portion 224 are aligned in the transverse direction T. Accordingly, a line that extends in the transverse direction T can pass through both the mating portion 222 and the mounting portion 224. The mating portion 222 extends from and is cantilevered from a top end 250*a* of the intermediate portion, and the mounting portion 224 extends from and is cantilevered from an opposed bottom end 250*b* of the intermediate portion 250. The mating portion 222 defines a contact portion 256 that is illustrated as substantially hook-shaped and defines a contact surface that can be brought into mechanical and electrical contact with a complementary electrical terminal such that the mating portion 222 is placed in compression, thereby reliably mating the mating portion 222 to the complementary electrical terminal.

The mounting portion 224 can include a mounting member that can be configured as a substantially planar mounting plate 262 that extends laterally rearward with respect to the bottom end 250*b* of the intermediate portion 250 in a direction angularly offset, such as perpendicular, with respect to the intermediate portion 250. As illustrated, the mounting plate 262 can extend substantially flat in the horizontal plane, along a direction substantially perpendicular with respect to the intermediate portion 250. The mounting plate 262 can have a transverse thickness greater than a remaining portion of the electrical terminal 220, or can have a substantially constant thickness with respect to the remaining portion of the electrical terminal 220.

The mounting potion 224 of at least one up to all of the electrical terminals 220 can further includes at least one crimp member 267, such as a pair of crimp members 267*a* and 267*b* spaced from each other along the length of the electrical terminals, for instance along the lateral direction A, and carried by the mounting plate 262. In particular, each crimp member 267 includes a plurality of crimp teeth 268 that extend out, such as down, from the mounting portion 224, to a tapered distal end 268*a* in accordance with the illustrated embodiment. For instance, each of the crimp teeth 268 can define a base 268*b* that attaches to the mounting plate 262 and a distal end 268*a* that is spaced from the base 268*b* along the transverse direction T. Thus, each crimp member 267 can extend from the mounting plate 262 along a direction that is substantially parallel to the direction in which the mating portion 222 is spaced from the mounting portion 224.

The electrical terminals 220 define respective mating portions 222 that face outwardly from a first housing surface (such as a surface defined by the top end 206 of the connector housing 204) along a first direction, and the crimp teeth 268 face outwardly from the second housing surface (such as a surface defined by the bottom end 208 of the connector housing 204) along a second direction that is angularly offset from the first direction. For instance, the second direction can be opposite the first direction, or can alternatively be substantially perpendicular to the first direction. The electrical terminals 220 define respective mating portions 222 that face outwardly from the first surface, and the crimp teeth 268 face outwardly from the second surface. Thus, the crimp teeth 268 can extend from the mounting plate 262 along a direction away from the respective mating portions 222, such that the distal end 268*a* is disposed further from the mating portion 222 than the base 268*b*. It should be appreciated, however, that the crimp teeth 268 can alternatively be inwardly facing, and thus extend from the mounting plate 262 along a direction toward the mating portion, such that the distal end 268*a* is disposed closer to the mating portion 222 than the base 268*b*, as described in U.S. patent application Ser. No. 13/226,864 filed Sep. 7, 2011, the disclosure of which is hereby incorporated by reference as if set forth in its entirety herein. Furthermore, the electrical terminal 220 defines first and second opposed surfaces, for instance one of the opposed surfaces disposed at the mating portion 222 of the electrical terminal 220, and the other of the opposed surfaces disposed at the mounting portion 224 of the electrical terminal 220. A first one of the opposed surfaces, for instance at the mating portion 222, is configured to mate with a complementary connector, and the opposed second surface that faces opposite the first surface, for instance at the mounting portion 224, is configured to secure the flat flex cable 22.

As illustrated, the crimp teeth 268 can be stamped or otherwise cut from the mounting plate 262 so as to define an aperture 270 that extends transversely through the mounting plate 262 at each crimp member. Alternatively, the crimp teeth 268 can be discretely attached (e.g., welded) to the mounting plate 262. The crimp members 267 can include four crimp teeth 268 that are equidistantly spaced from each other about a perimeter of an aperture 270 that extends through the mounting plate 262 along the transverse direction T. The crimp teeth 268 of each crimp member 267 can be arranged about a circumference, for instance of the aperture 270, or other curved surface such that each crimp member 267 resembles the shape of a star having any number of lobes, each lobe defined by one of the crimp teeth 268 in accordance with the illustrated embodiment. It should be appreciated, however, that each crimp member 267 can include at least one crimp tooth, such as a plurality of crimp teeth 268 that are spaced equidistantly or variably from each other. The crimp teeth 268 of each crimp member 267 can be spaced circumferentially from each other or in any suitable alternative arrangement.

During operation, at least one of the electrical terminals 220 up to all of the electrical terminals 220 can be configured so as to provide a spring force that has a directional component substantially normal to the contact surface of the mating portion 222. For instance, the contact surface of the mating portion 222 can be brought into mechanical and electrical contact with a complementary electrical terminal such that the mating portion 222 is placed in compression, thereby reliably mating the mating portion 222 to the complementary electrical terminal. For instance, when the contact surface of the mating portion 222, receives a force in the transverse direction T toward the mounting portion 224 (for instance applied by the complementary electrical terminal), at least a portion of the electrical terminal 220 flexes so as to compress along the transverse direction T toward the mounting portion 224.

The mounting portions 224 can be electrically connected to the flat flex cable 22 by crimping the crimp teeth 268 onto the flat flex cable 22, thereby placing the electrical terminals 220 in electrical communication with the electrical traces that run through the flat flex cable 22. For instance, the flat flex cable 22 can be placed against the bottom end 208 of the connector housing 204 such that the crimp teeth 268 pierce through the flat flex cable. Next, the crimp member 267 can be stamped with a die, which is brought against the crimp teeth 268, causing the crimp teeth 268 to fold back along a second direction substantially opposite the first direction such that the tapered distal ends 268*a* pierce the flat flex cable 22. Thus, the crimp teeth 268 of at least one of the crimp members 267 contacts electrical traces that run therethrough so as to electrically connect the electrical terminals 220 to the flat flex cable 22 as illustrated in FIG. 1. Thus, the crimp teeth 268 can be flexible so as to fold back under the stamping force. The stamping operation can cause the crimp teeth 268 to fold outward or inward as desired. Thus, as the die is brought into contact with the crimp teeth 268, the bottom end 208 of the connector housing 204 provides a mandrel that supports the stamping operation.

Figure 3A:
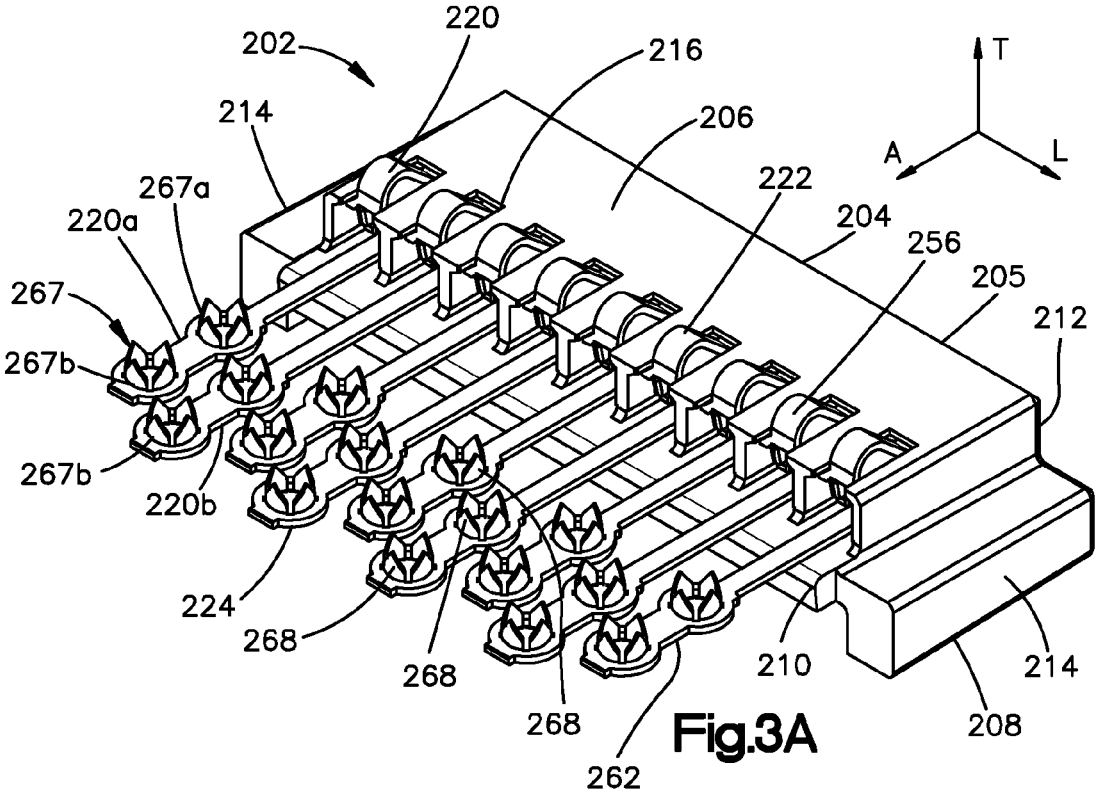
FIG. 3A is a perspective view of the electrical connector illustrated in FIG. 1A, including a connector housing and electrical terminals supported by the electrical housing, showing the electrical terminals in a first orientation configured to be mounted to the flexible printed circuit in accordance with one embodiment.
Figure 3B:
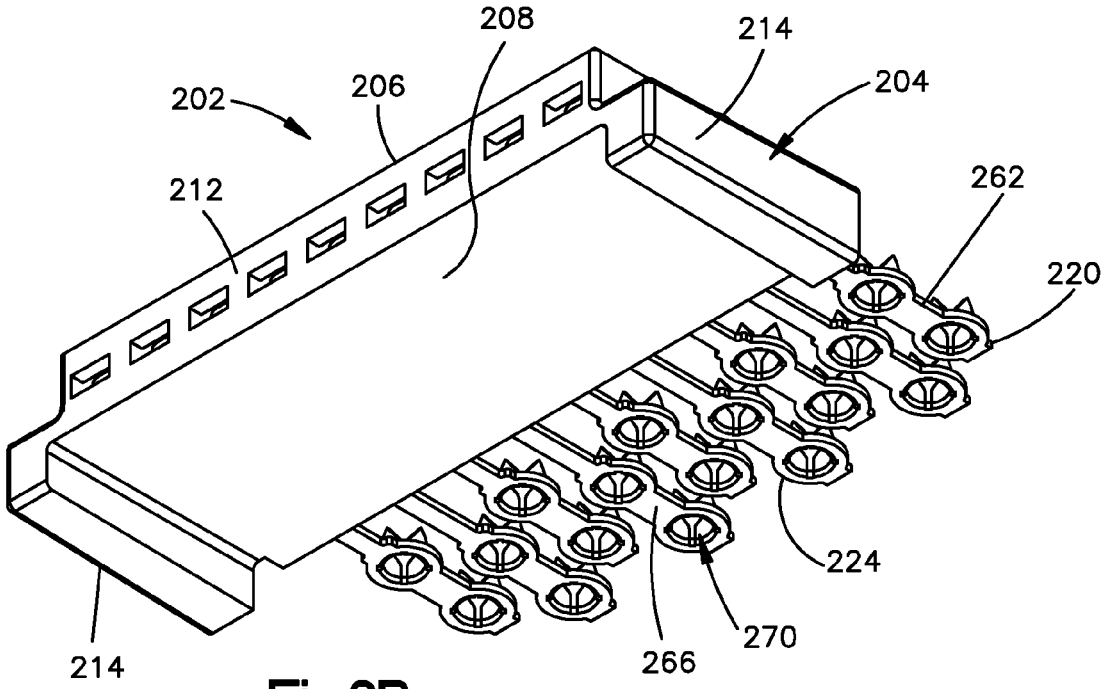
FIG. 3B is another perspective view of the electrical connector illustrated in FIG. 2A.
Figure 3C:
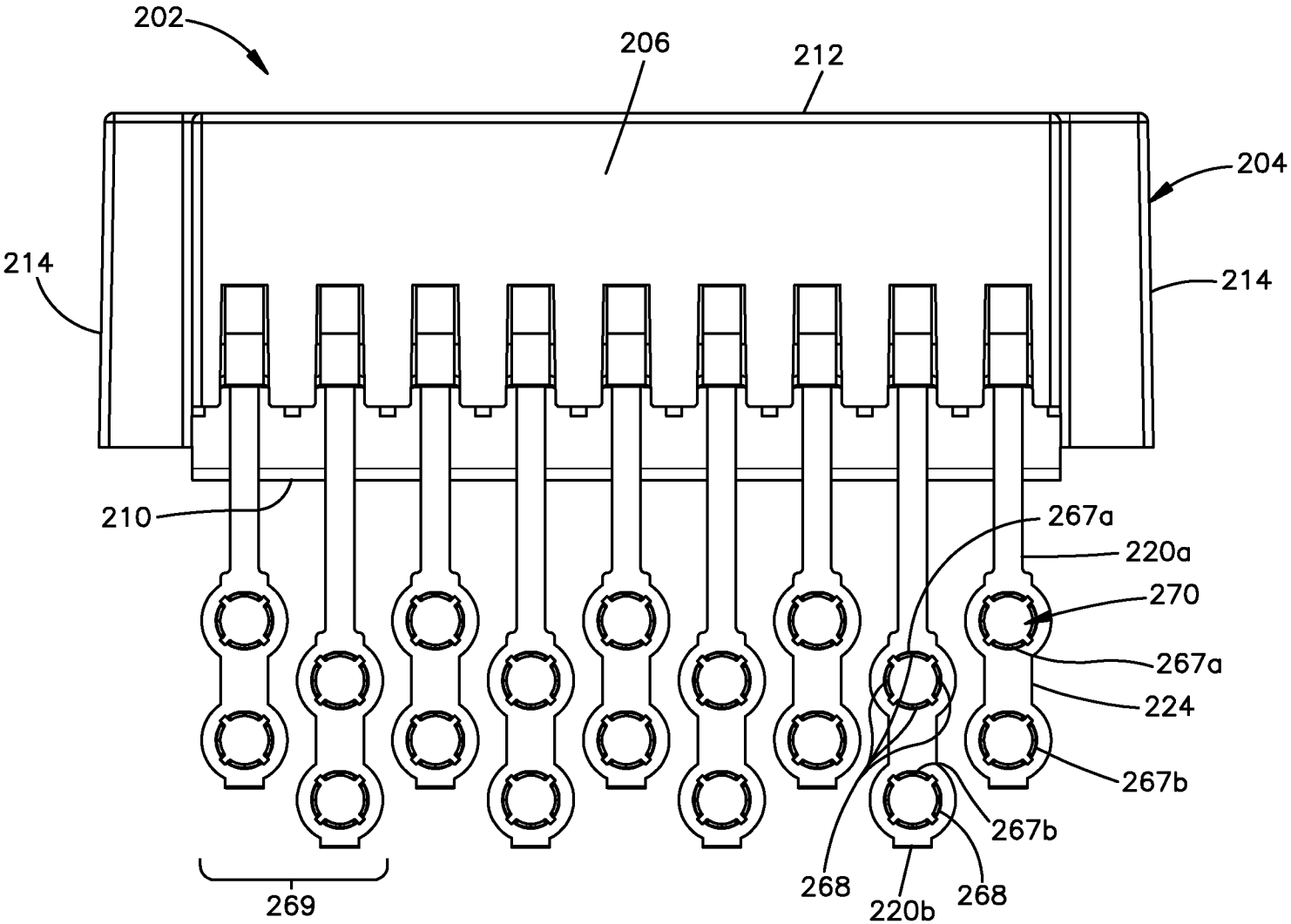
FIG. 3C is a top plan view of the electrical connector illustrated in FIG. 3A.
Figure 3D:
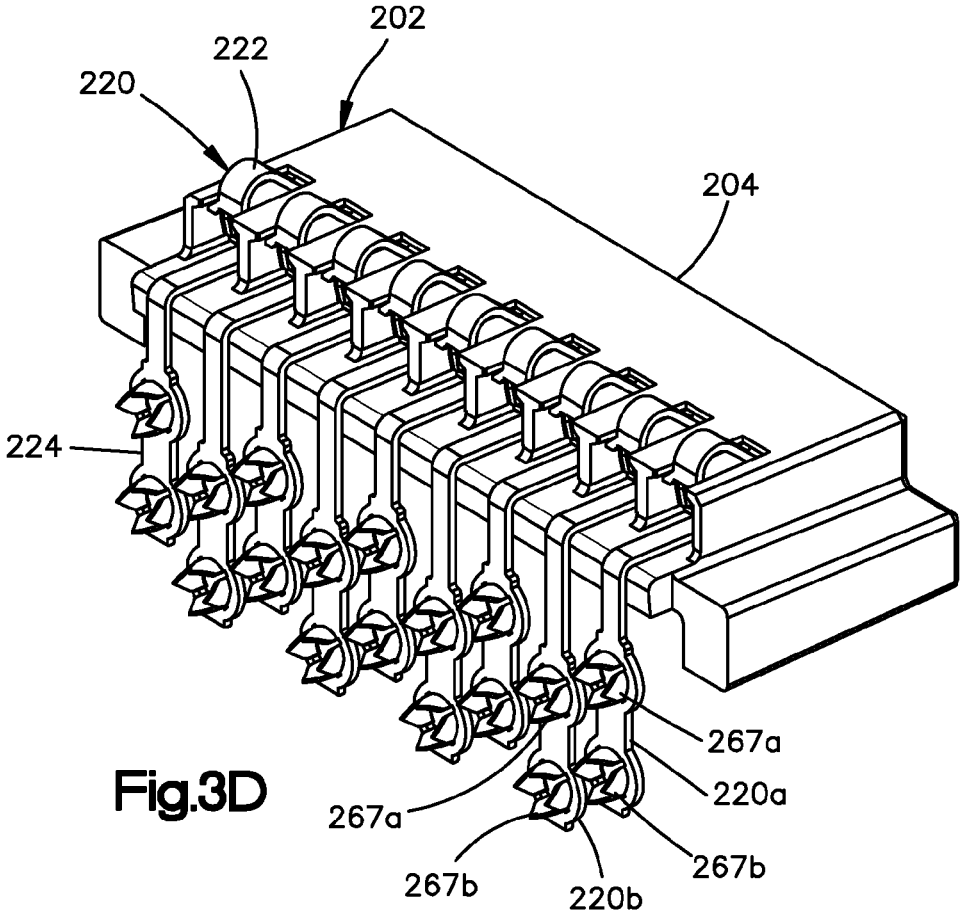
FIG. 3D is a perspective view of the electrical connector illustrated in FIG. 3A, but showing the electrical terminals in a second orientation different than the first orientation and configured to be mounted to the flexible printed circuit.
Figure 3E:
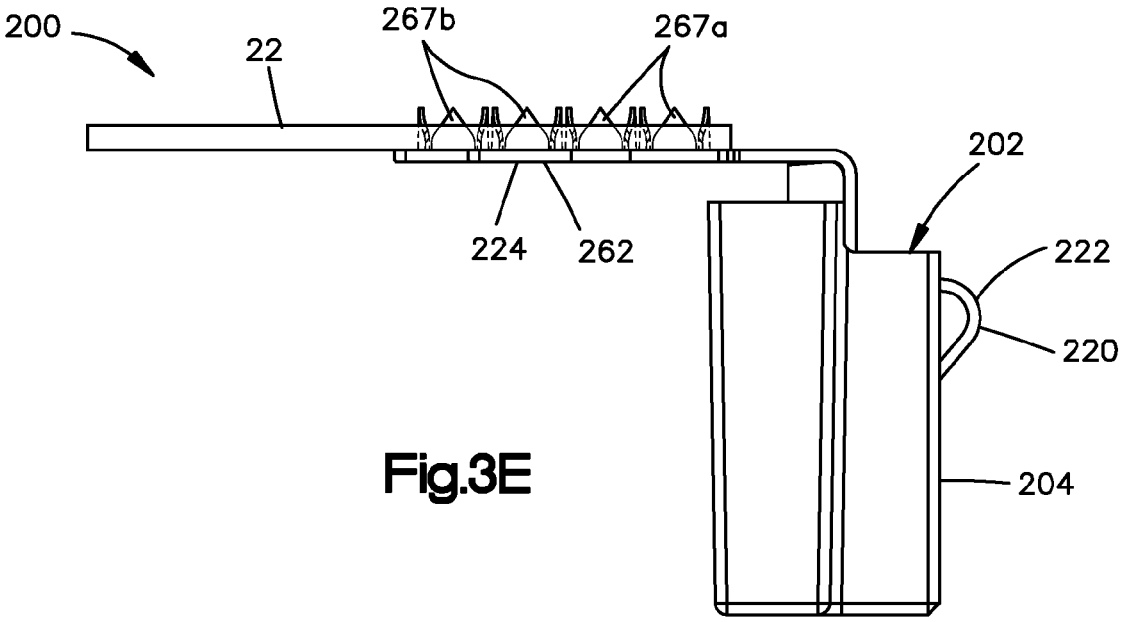
FIG. 3E is a side elevation view of the electrical connector assembly illustrated in FIG. 3D, shown mounted to the flexible printed circuit.

Referring to FIGS. 3A-C, the mounting portion 224, and thus the mounting plate 262 can extend out from the connector housing 204 during the stamping operation, such that a surface of the electrical terminals 220 opposite the crimp teeth 268 is braced against a support, such as a first die. For instance, the mounting plate 262 can extend out from the top end 206 of the connector housing 204 along a direction substantially parallel or coplanar with the top end 206 of the connector housing 204 (and thus extend in a first plane defined by the lateral direction A and the longitudinal direction L). Alternatively, the mounting plate 262 can extend along a direction angularly offset with respect to the top end 206 (and thus extend in a second plane that is different than the first plane) as illustrated in FIGS. 3D-E. The flat flex cable 22 can be placed adjacent the crimp teeth 268, for instance adjacent the tapered distal ends 268*a*, and brought against the crimp teeth 268 such that the crimp teeth 268 pierce the flat flex cable 22 and extend through the flat flex cable 22. A second die can be positioned adjacent the crimp teeth 268, such that the flat flex cable 22 and the mounting portion 224 are disposed between the first and second dies. The first and second dies can then be brought toward each other after the crimp teeth 268 have pierced through the flat flex cable 22, thereby causing the crimp teeth 268 to fold back toward the flat flex cable 22 such that the tapered distal ends 268*a* are embedded in the flat flex cable 22. Alternatively, the crimp teeth 268 can pierce through the flat flex cable 22, and the mounting plate 262 can lie against the connector housing, and in order to reduce the crimp forces applied to the connector housing 204 during the stamping operation, the connector housing 204 can be reinforced with a plate or any suitable structure, such as a reinforcement tool that can support the inner surface of the connector housing 204 at the crimp members 267 as desired to provide structural support to the integrity of the connector housing 204 as crimp forces are applied to the crimp teeth 268 and the connector housing 204. The crimp teeth 268 can have any height when uncrimped as desired, it being appreciated that as the height of the crimp teeth 268 increases, the crimp teeth 268 can be crimped against the flat flex cable 22 under reduced stamping forces that are applied against the connector housing 204.

Crimping the crimp teeth 268 against the flat flex cable 22 causes the electrical terminals 220 to place the complementary electrical device that is mated to the mating portions 222 of the electrical terminals 220 in electrical communication with the flat flex cable 22. The flat flex cable 22 can thus define a first end that is mounted onto mounting portions 224 of the terminals, and an opposed second end that is electrically connected to a complementary electrical device, such as a sensor or a processor. Thus, the flat flex cable 22 can place a processor in electrical communication with the mounting portions 224 of the electrical terminals 220 and the mating portions 222 can be electrically connected to a sensor. Conversely, the flat flex cable 22 can place a sensor in electrical communication with the mounting portions 224 of the electrical terminals 220 and the mating portions 222 can be electrically connected to a processor. It should be appreciated that the crimp members 267 can secure a flexible connection to a complementary electrical device, while allowing the electrical connector 202 to have a compact design while providing for ease of manufacturability.

Figure 4A:
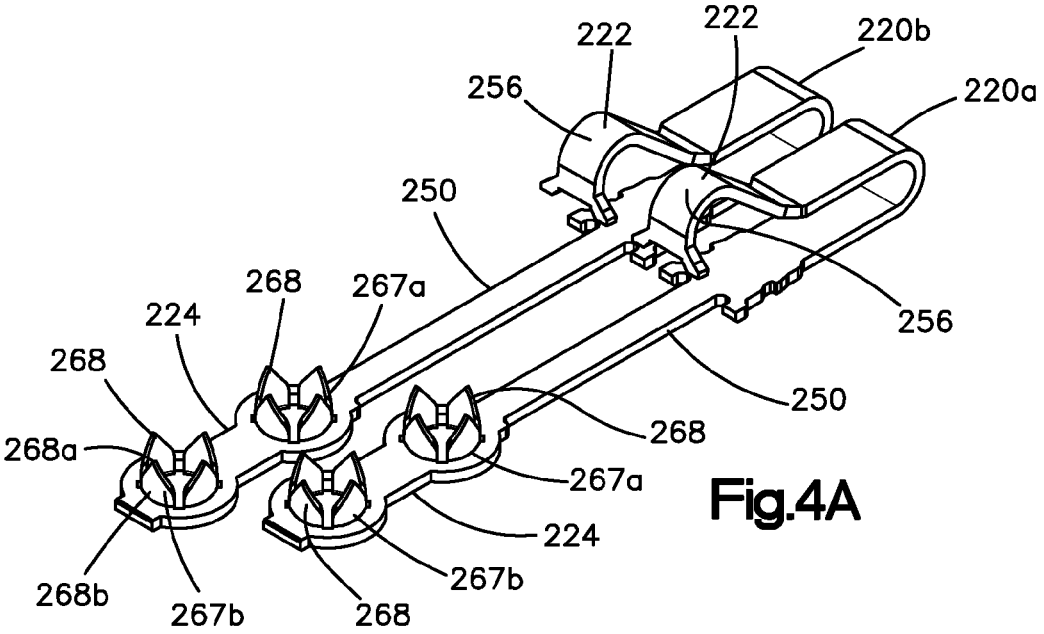
FIG. 4A is a perspective view of a pair of the electrical terminals as supported by the connector housing illustrated in FIG. 2A.
Figure 4B:
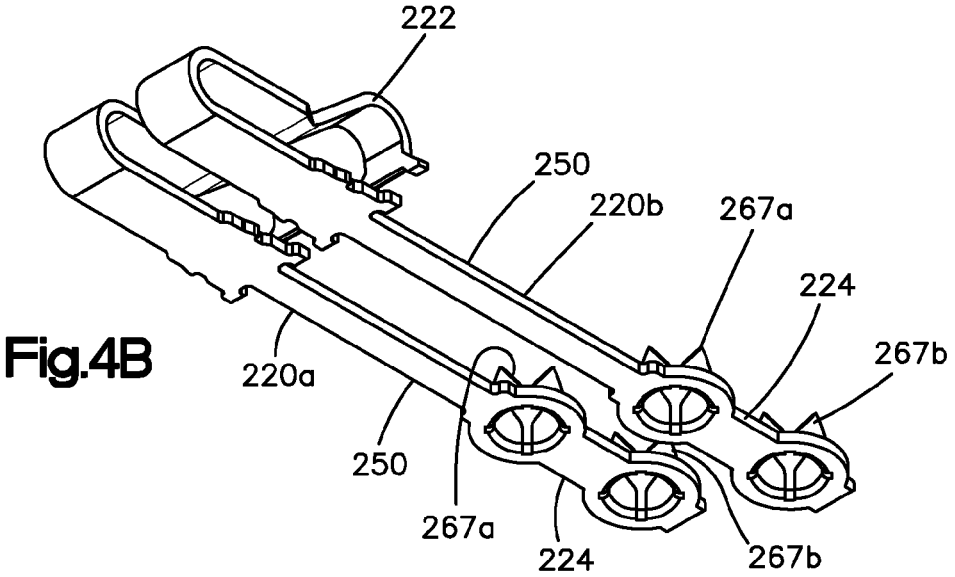
FIG. 4B is another perspective view of the pair of electrical terminals illustrated in FIG. 4A.
Figure 4C:
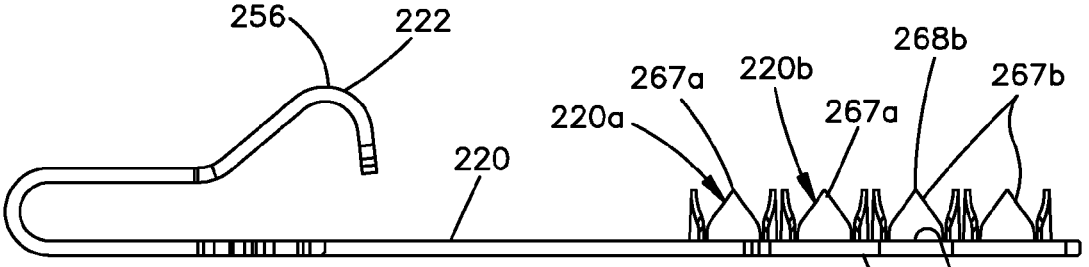
FIG. 4C is a side elevation view of the pair of electrical terminals illustrated in FIG. 4A.
Figure 5A:
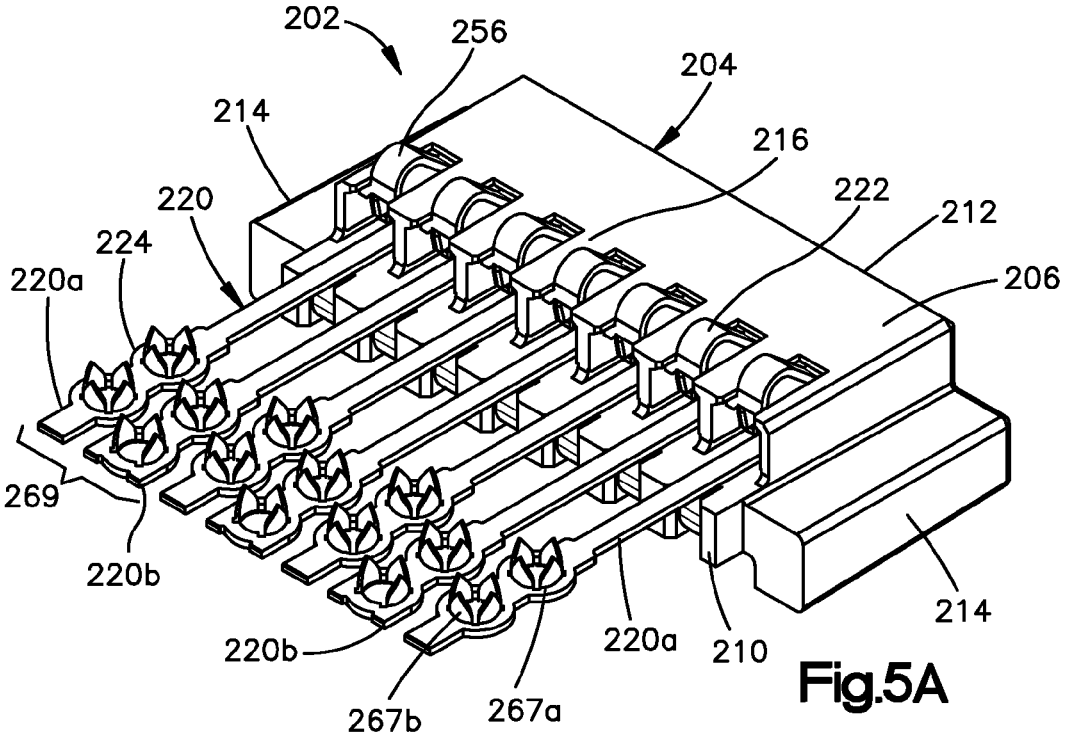
FIG. 5A is a perspective view of the electrical connector illustrated in FIG. 2A, showing certain ones of the electrical terminals having crimp members with different numbers of crimp teeth.
Figure 5B:
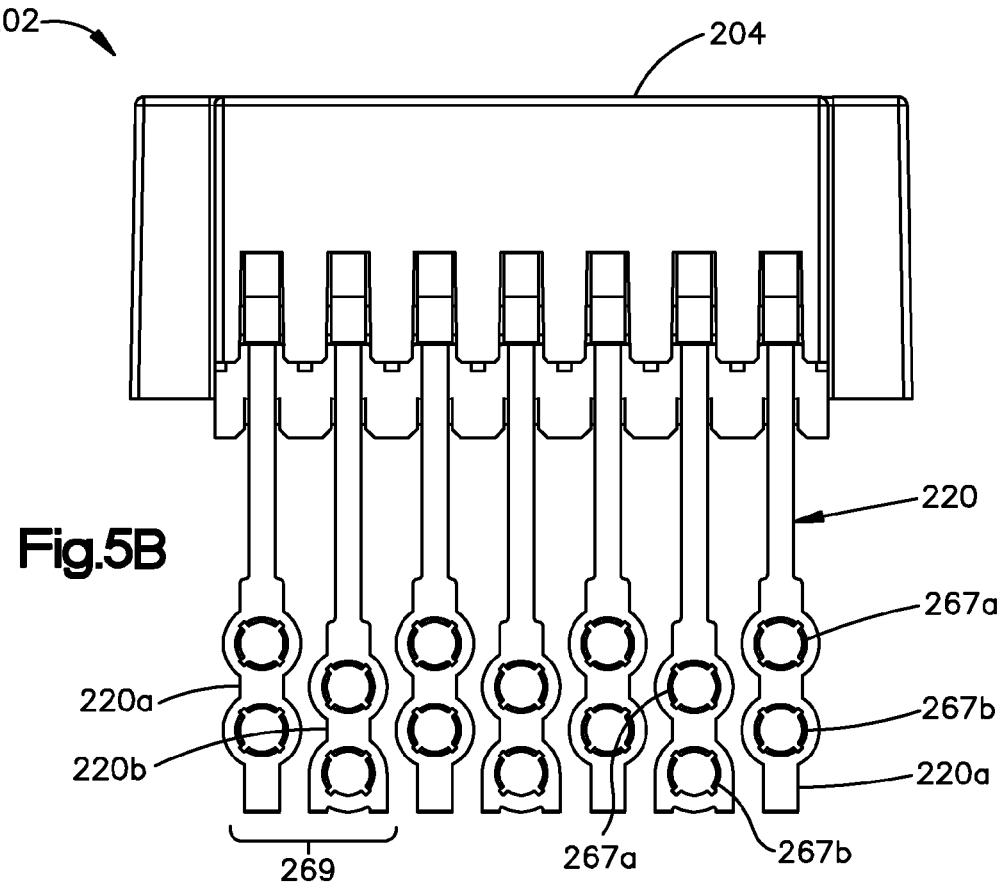
FIG. 5B is a top plan view of the electrical connector illustrated in FIG. 5A.
Figure 6A:
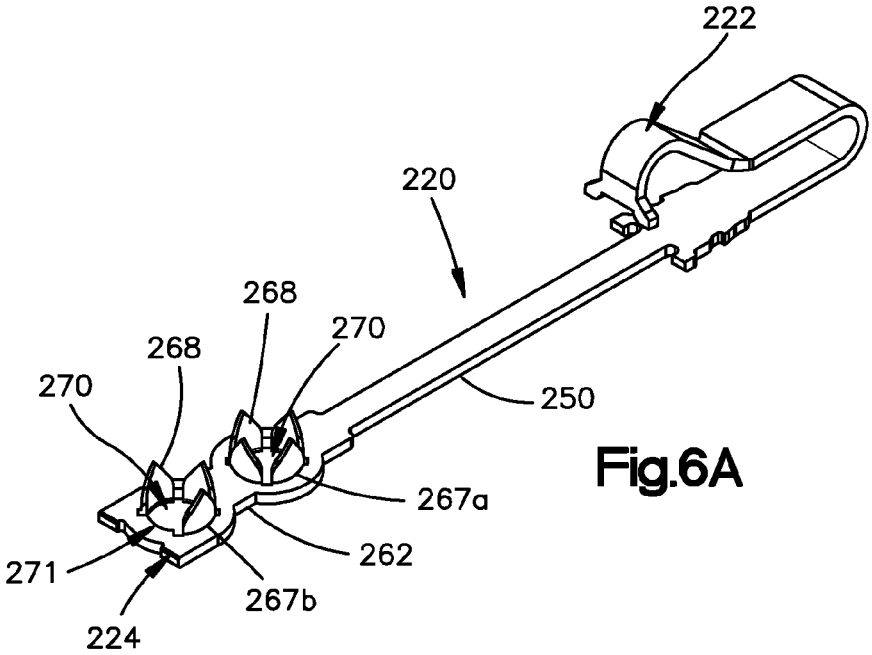
FIG. 6A is a perspective view of one of the electrical terminals of the electrical connector illustrated in FIG. 5A.
Figure 6B:
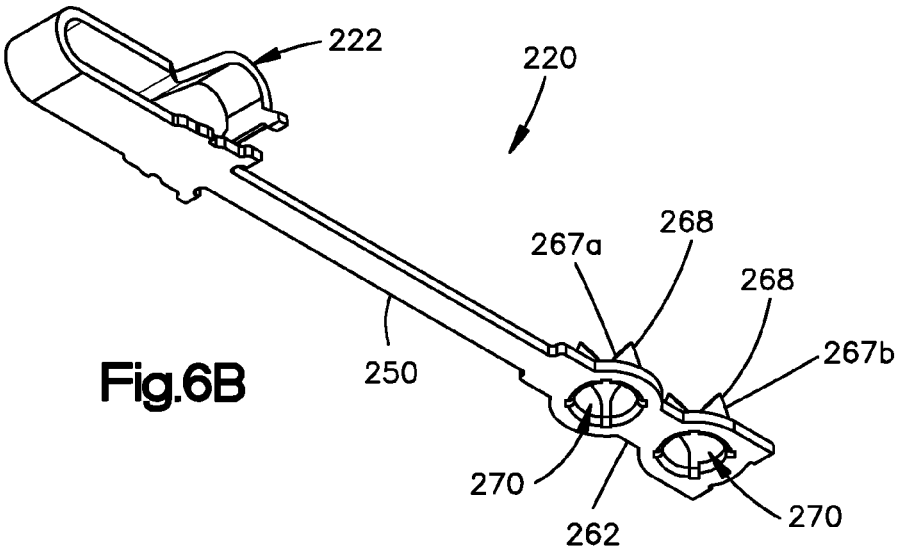
FIG. 6B is another perspective view of the electrical terminal illustrated in FIG. 6A.
Figure 6C:
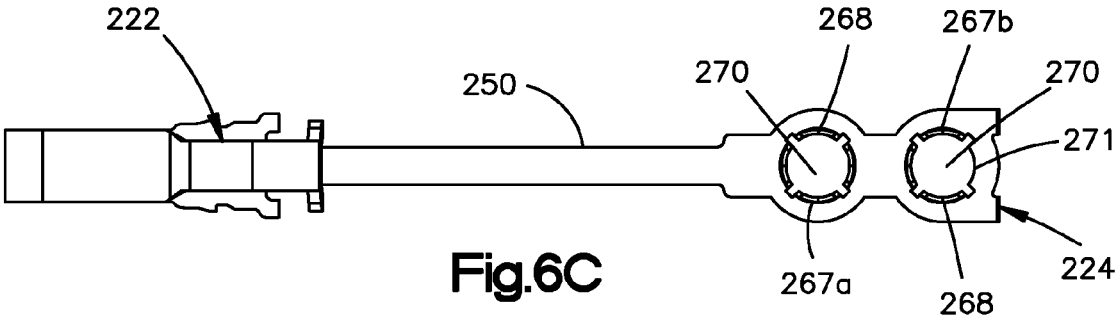
FIG. 6C is a top plan view of the electrical terminal illustrated in FIG. 6A.

Referring to FIGS. 4A-C, the electrical terminal 220 further includes at least one crimp member 267 at the mounting portion 224, such as a first or inner crimp member 267*a* and a second or outer crimp member 267*b* that is outwardly, for instance rearwardly when the electrical terminals 220 are fully installed on the connector housing 204, spaced from the inner crimp member 267*a*. The crimp teeth 268 of the first crimp member 267*a* can be disposed about a first perimeter, which can be a perimeter of a first aperture 270, and the crimp teeth 268 of the second crimp member can be disposed about a second perimeter different than the first perimeter. For instance, the second perimeter can be discontinuous with the first perimeter. In accordance with the illustrated embodiment, the second perimeter can be a perimeter of an aperture 270 that is different than the aperture 270 of the first crimp member 267*a*. Furthermore the first and second perimeters can be substantially circular or alternatively shaped. The electrical terminals 220 can be arranged in one or more pairs 269 of electrical terminals 220. Each pair can include a first electrical terminal 220*a* of the electrical terminals 220 and a second electrical terminal 220*b* of the electrical terminals 220 that is adjacent the first terminal. Thus, the electrical connector 202 can define at least one first electrical terminal 220*a* and at least one second electrical terminal 220*b*.

The first and second electrical terminals 220*a* and 220*b* can be alternatingly arranged along the connector housing 204 in the longitudinal direction L. Thus, first electrical terminals 220*a* are disposed adjacent, and can be disposed between, the second electrical terminals 220*b*, and the second electrical terminals 220*b* are disposed adjacent, and can be disposed between, the first electrical terminals 220*a*. The first crimp members 267*a* of each of the first electrical terminals 220*a* can be aligned along the longitudinal direction L, and the second crimp members 267*b* of each of the first electrical terminals 220*a* can be aligned along the longitudinal direction L. Thus, a straight line extending in the longitudinal direction L can substantially pass through the center of the first crimp members 267*a* of the first electrical terminals 220*a*, and a straight line extending in the longitudinal direction L can substantially pass through the center of the second crimp members 267*b* of the first electrical terminals 220*a*. Likewise, the first crimp members 267*a* of each of the second electrical terminals 220*b* are aligned along the longitudinal direction L, and the second crimp members 267*b* of each of the second electrical terminals 220*b* are aligned along the longitudinal direction L. Thus, a straight line extending in the longitudinal direction L can substantially pass through the center of the first crimp members 267*a* of the second electrical terminals 220*b*, and a straight line extending in the longitudinal direction L can substantially pass through the center of the second crimp members 267*b* of the second electrical terminals 220*b*.

In accordance with the illustrated embodiment, the first crimp members 267*a* of each of the first electrical terminals 220*a* are offset along the lateral direction A with respect to the first and second crimp members 267*a* and 267*b* of each of the second electrical terminals 220*b*. Thus, the first crimp members 267*a* of each of the first electrical terminals 220*a* are not aligned along the longitudinal direction L with the first crimp member 267*a* of each of the second terminals 267*b*, and the first crimp members 267*a* of each of the first electrical terminals 220*a* are not aligned along the longitudinal direction with the second crimp member 267*b* of each of the second electrical terminals 220*b*. Accordingly, a straight line that extends along the longitudinal direction L and passes through the center of the first crimp members 267*a* of the first electrical terminals 220*a* does not pass through the center of either or both of the first or the second crimp members 267*a* and 267*b* of the second electrical terminals 220*b*. Likewise, the second crimp members 267*b* of each of the first electrical terminals 220*a* are offset with respect to the first and second crimp members 267*a* and 267*b* of each of the second electrical terminals 220*b* along the lateral direction A. Accordingly, a straight line that extends in the longitudinal direction L and passes through the center of the second crimp members 267*b* of the first electrical terminals 220*a* does not pass through the center of either or both of the first or the second crimp members 267*a* and 267*b* of the second electrical terminals 220*b*.

Similarly, the first crimp members 267*a* of each of the second electrical terminals 220*b* are offset along the lateral direction A with respect to the first and second crimp members 267*a* and 267*b* of each of the first electrical terminals 220*a*. Thus, the first crimp members 267*a* of each of the second electrical terminals 220*b* are not aligned along the longitudinal direction L with the first crimp member 267*a* of each of the first electrical terminals 220*a*. The first crimp members 267*a* of each of the second electrical terminals 220*b* are further not aligned along the longitudinal direction L with the second crimp member 267*b* of each of the first electrical terminals 220*a*. Accordingly, a straight line that extends along the longitudinal direction L and passes through the center of the first crimp members 267*a* of the second electrical terminals 220*b* does not pass through the center of either or both of the first or the second crimp members 267*a* and 267*b* of the first electrical terminals 220*a*. Likewise, the second crimp members 267*b* of each of the second electrical terminals 220*b* are offset with respect to the first and second crimp members 267*a* and 267*b* of each of the first electrical terminals 220*a* along the lateral direction A. Accordingly, a straight line that extends in the longitudinal direction L and passes through the center of the second crimp members 267*b* of the second electrical terminals 220*b* does not pass through the center of either or both of the first or the second crimp members 267*a* and 267*b* of the first electrical terminals 220*a*.

The first and second crimp members 267*a* and 267*b* of the second electrical terminals 220*b* can be laterally outwardly disposed with respect to the respective first and second crimp members 267*a* and 267*b* of the first electrical terminals 220*a*, though it should be appreciated that the first and second crimp members 267*a* and 267*b* of the first electrical terminals 220*a* can be laterally outwardly disposed with respect to the first and second crimp members 267*a* and 267*b* of the second electrical terminals 220*b*.

Each crimp member 267 includes a plurality of outwardly extending electrically conductive crimp teeth 268 that are configured to secure the flat flex cable 22 in the manner described above. For instance, one of the first and second crimp members 267*a* and 267*b* is configured to electrically connect to electrical traces of the flat flex cable 22, while the other of the first and second crimp members is configured to provide strain relief for the crimp member that is electrically connected to the flat flex cable 22. For instance, the crimp teeth 268 of the second crimp members 267*b* can engage the flat flex cable 22 such that a majority of a rearwardly directed tensile force applied to the FPC is communicated to the crimp teeth 268 of the second crimp members 267*b*, while the crimp teeth 268 of the first crimp members 267*a* that are electrically connected to the flat flex cable 22 are not biased out of electrical connection with the flat flex cable 22 by the applied tensile force. It should be appreciated that when the electrical terminals 220 are electrically connected to the flat flex cable 22, the flat flex cable 22 extends along a rearward direction from the first crimp member 267*a* toward the second crimp member 267*b*, and defines a length greater than the distance between the second crimp member 267*b* and the rear end 212 of the connector housing 204.

In accordance with the embodiment illustrated in FIGS. 1-4C, each of the first and second crimp members 267*a* and 267*b* of each of the first and second electrical terminals 220*a* and 220*b* can have the same number of crimp teeth 268.

Referring now to FIGS. 5A-6C, it should be appreciated that one of the first and second crimp members 267*a* and 267*b* of a select at least one, such as a plurality, up to all, of the first and second electrical terminals 220*a* and 220*b* can have a different number of crimp teeth 268 than the other of the first and second crimp members 267*a* and 267*b*. For instance, in accordance with the illustrated embodiment, the second crimp members 267*b* of the second electrical terminals 220*b* can have a different number, such as fewer or more, crimp teeth 268 with respect to the number of crimp teeth 268 of the first crimp members 267*a* of the second electrical terminals 220*b*. Furthermore, one of the first and second crimp members 267*a* and 267*b* of the first electrical terminals 220*a* can have the same number of teeth as the other of the first and second crimp members 267*a* and 267*b* of the first electrical terminals 220*a*. The first and second crimp members 267*a* and 267*b* of the first electrical terminals 220*a* can have the same number of teeth as, or a different number of teeth than, the second crimp member 267*b* of the second electrical terminals 220*a*.

In accordance with the illustrated embodiment, the first crimp member 267*a* of each of the second electrical terminals 220*b* has four crimp teeth 268, and the second crimp member 267*b* of each of the second electrical terminals 220*b* has three crimp teeth 268, and the first and second crimp members 267*a* and 267*b* of the first electrical terminals 220*a* each have four crimp teeth 268, though it should be appreciated that the number of crimp teeth can differ. Accordingly, in accordance with one embodiment, the crimp member 267 that provides strain relief for the electrical interface between the electrical terminals 220 and the flat flex cable 22 can define a fewer number of teeth than the crimp member 267 that is in electrical contact with the electrical traces of the flat flex cable 22. Alternatively, the crimp member 267 that provides strain relief for the electrical interface between the electrical terminals 220 and the flat flex cable 22 can define a greater number of teeth than the crimp member 267 that establishes electrical contact with the electrical traces of the flat flex cable 22. It should be appreciated that both crimp members 267 can establish electrical contact with the electrical traces of the flat flex cable 22, while one of the crimp members also provides strain relief for the other of the crimp members. Furthermore, in accordance with the illustrated embodiment, the crimp teeth 268 of the second crimp member 267*b* can be configured so as to be variably spaced from each other about the aperture 270. For instance, the crimp teeth 268 of the second crimp member 268 define a pair of crimp teeth 268 that are spaced from each other along the longitudinal direction, and single one of the crimp teeth 268 that is spaced forward along the lateral direction from a gap 271 that is disposed between ones of the pair of crimp teeth 268.

Furthermore, it should be appreciated that the first crimp members 267*a* of the first electrical terminals 220*a* can be aligned with the first crimp members 267*a* of the second electrical terminals 220*b* along the longitudinal direction L, and the second crimp members 267*b* of the first electrical terminals 220*a* can be aligned with the second crimp members 267*b* of the second electrical terminals 220*b* along the longitudinal direction L as desired.

Figure 7:
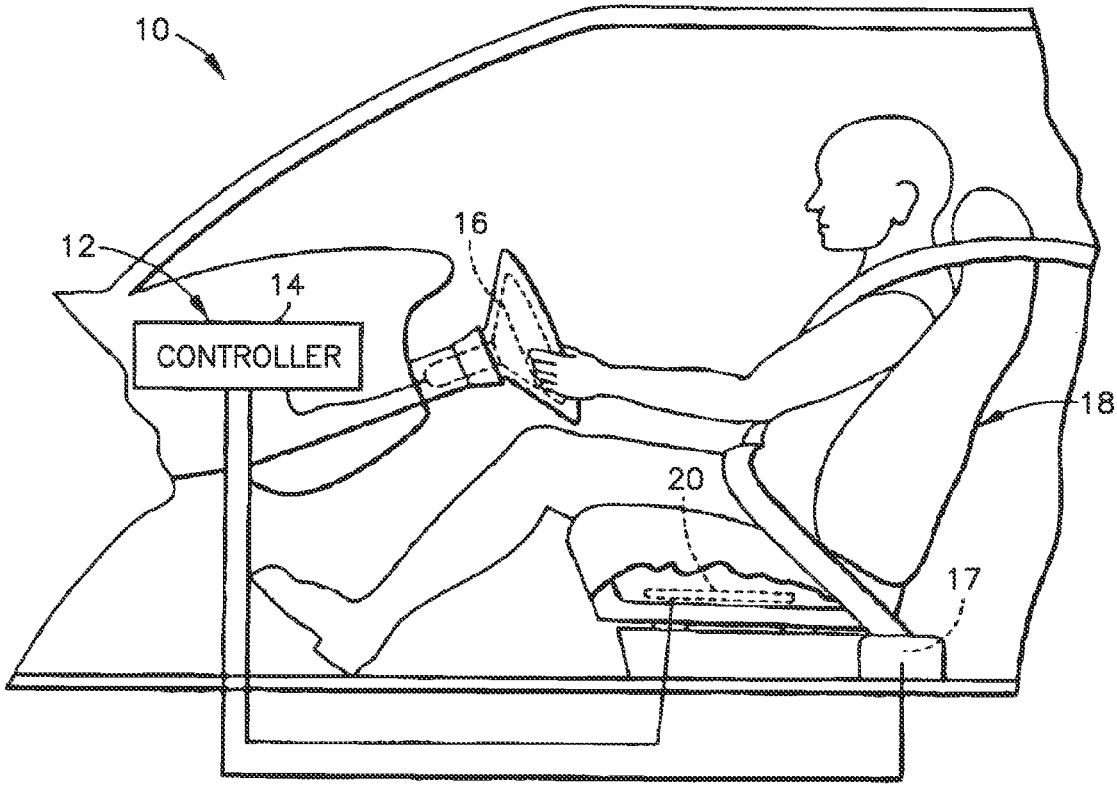
FIG. 7 is a diagrammatic view of a portion of a vehicle having a safety restraint system that includes the electrical connector assembly illustrated in FIG. 1.

Referring to FIG. 7, there is shown a diagrammatic view of a portion of a vehicle 10 having a safety restraint system 12 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

A similar safety restraint system is described in U.S. Pat. Nos. 6,129,168 and 6,932,382, the disclosure of each of which is hereby incorporated by reference in its entirety. The safety restraint system 12 generally comprises a controller 14, airbags 16, 17, and a seat sensor device 20 located in a seat 18. In the embodiment shown, the air bag 16 is a steering wheel mounted air bag. The air bag 17 is a seat belt mounted air bag. The controller 14 can be connected to other air bags in the vehicle 10, such as a passenger side dashboard mounted air bag and side mounted air bags, for example. The controller 14 is connected to the air bags 16, 17 to control their deployment. The controller 14 is also connected to various sensors located about the vehicle as is generally known in the art.

One of the sensors connected to the controller 14 is the seat sensor device 20 located in the seat 18. In the embodiment shown, the seat sensor device 20 is shown in the driver's seat. One or more additional seat sensor devices could be located in one or more of the passenger seats. The seat sensor device 20 is adapted to determine the size and position of a person sitting in the seat. The information sensed by the seat sensor device 20 is transmitted back to the controller 14 to allow the controller to determine if and/or at what force the air bags 16, 17 should be deployed in the event of an accident.

Figure 8:
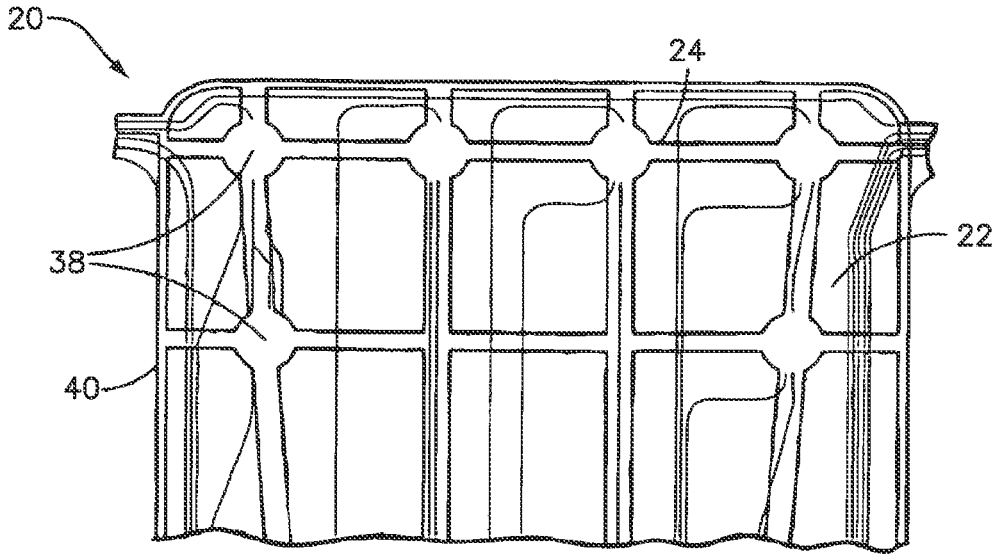
FIG. 8 is a top plan view of a seat sensor device used in the vehicle safety restraint system shown in FIG. 7.
Figure 9:
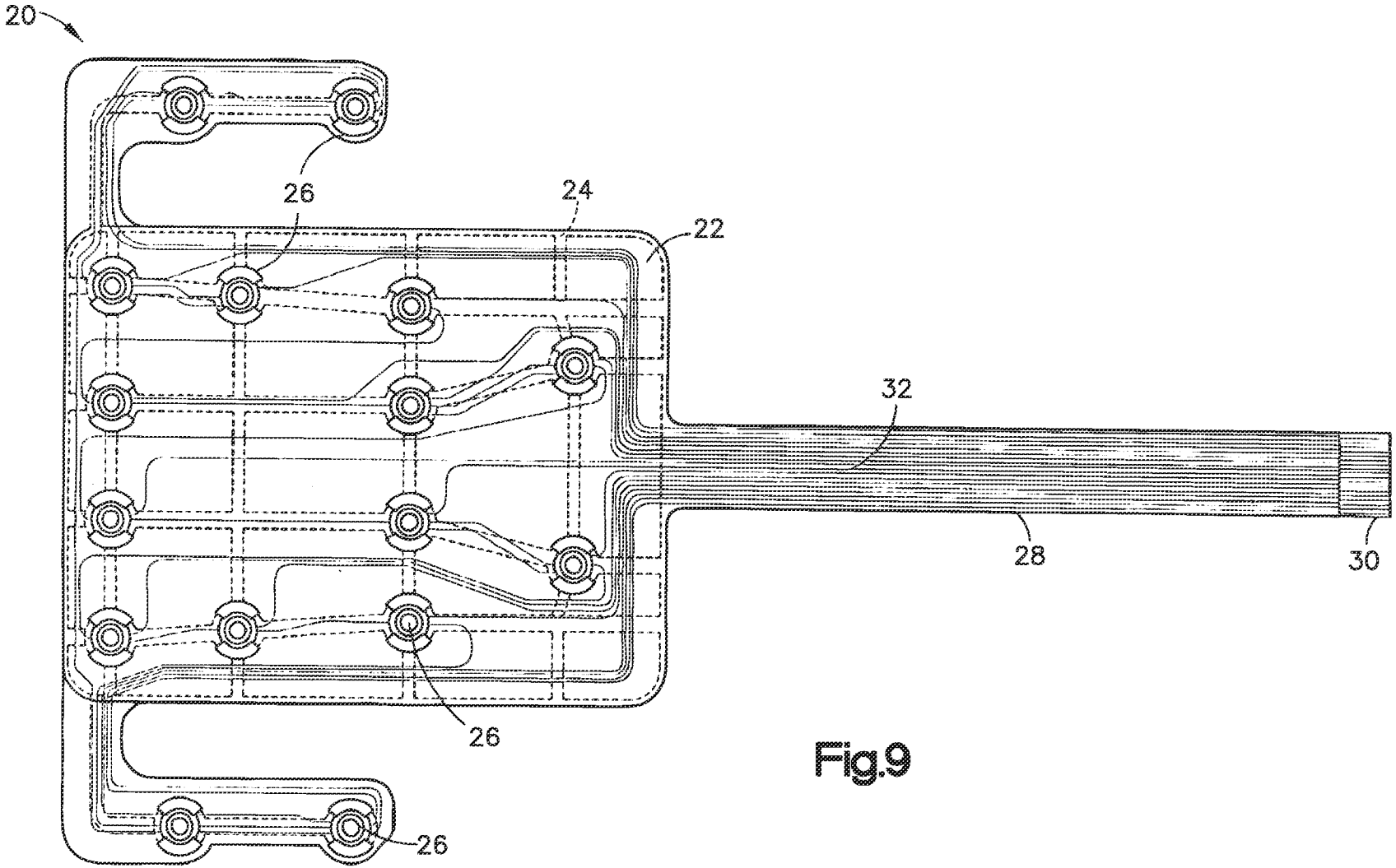
FIG. 9 is a bottom plan view of a portion of the seat sensor device shown in FIG. 8.
Figure 10:
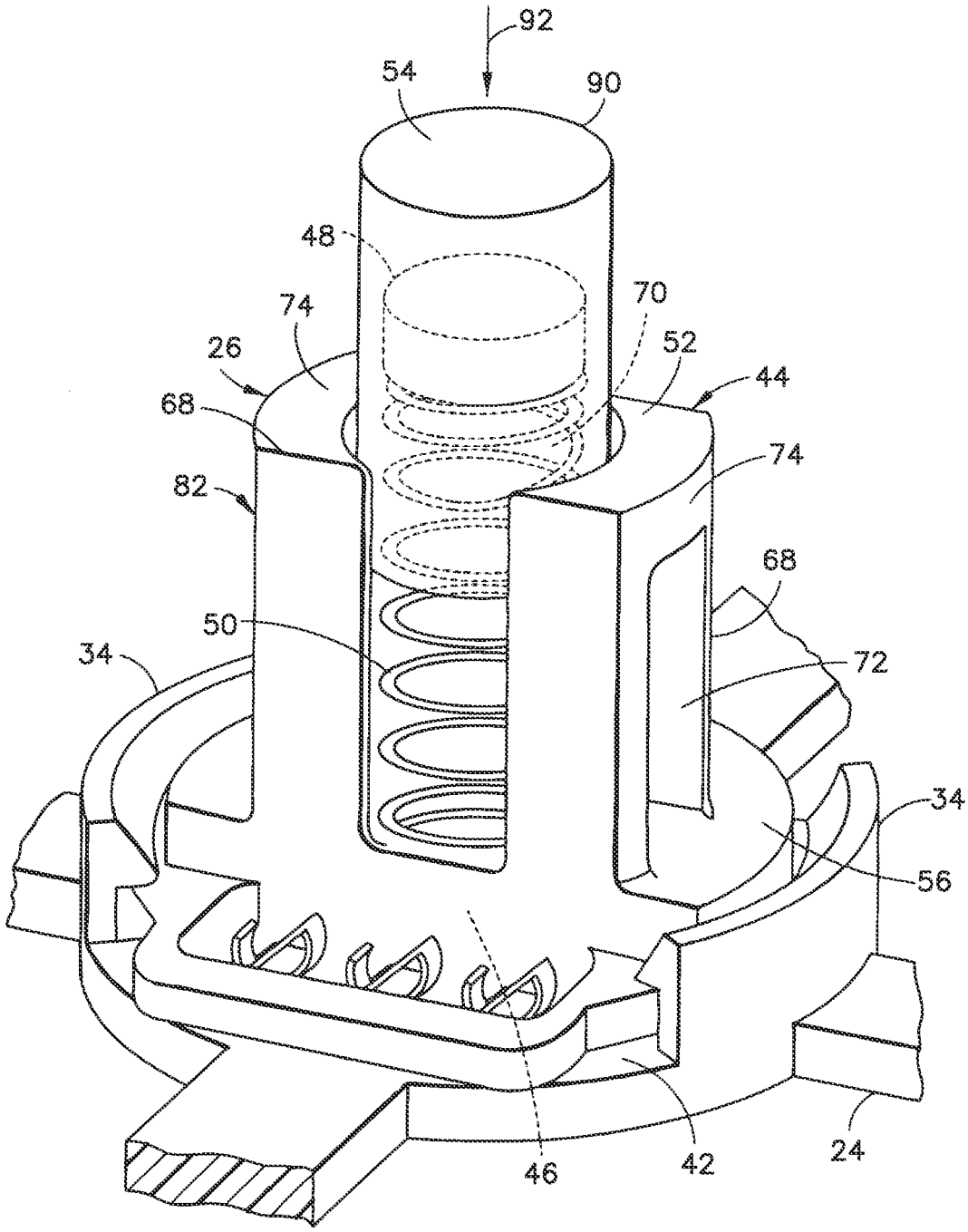
FIG. 10 is an enlarged perspective view of a portion of the seat sensor device shown in FIG. 8, but without showing the flexible printed circuit may merely for the sake of clarity.
Figure 11:
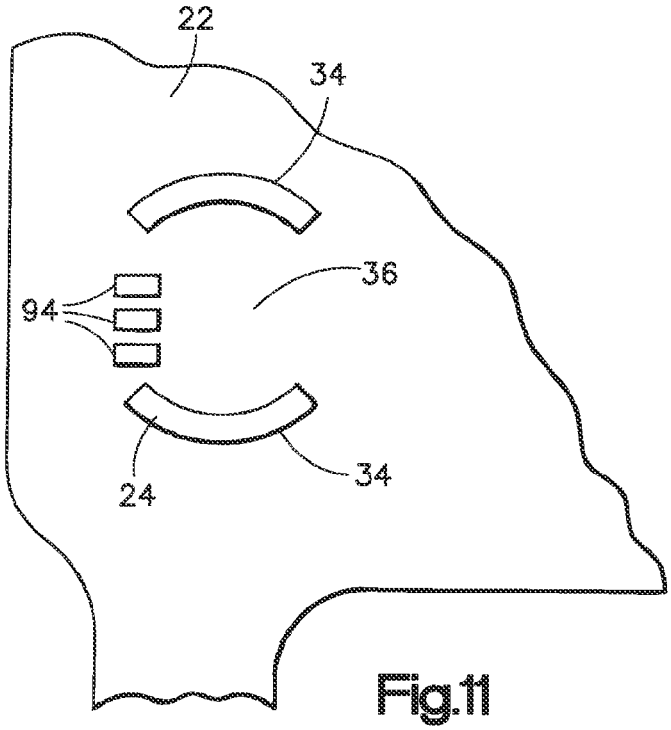
FIG. 11 is a partial top plan view of a portion of the flexible printed circuit mat, the frame, and three terminals prior to connection of a Hall effect sensor assembly.
Figure 12:
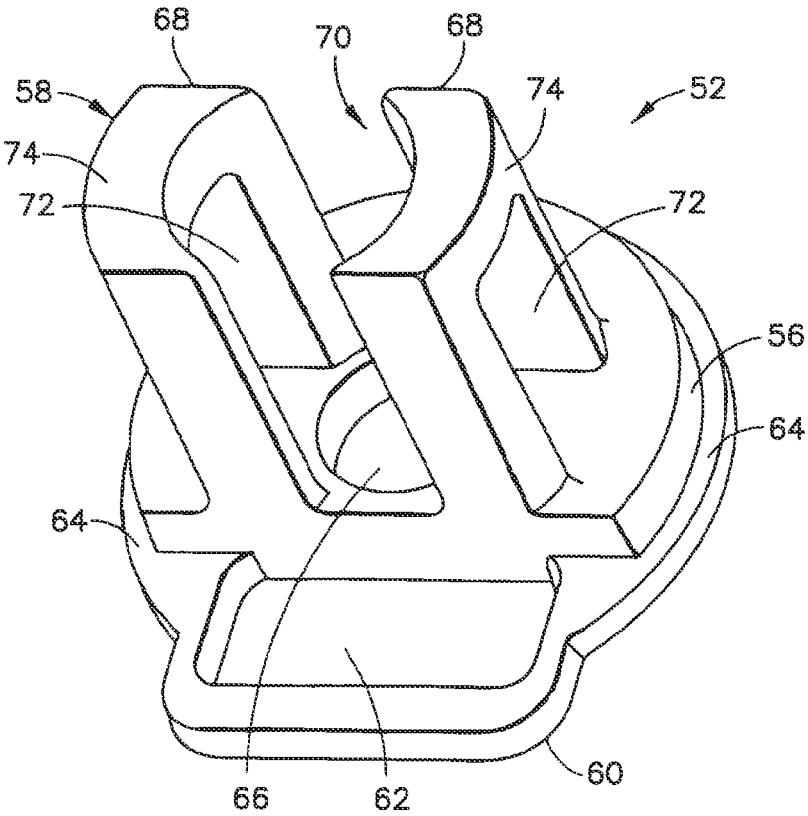
FIG. 12 is a perspective view of a first housing member of the sensor assembly shown in FIG. 10.

Referring now also to FIGS. 8-10, the seat sensor device 20 generally comprises a flexible printed circuit (FPC) 22, a frame 24, and a plurality of Hall effect sensor assemblies 26. The controller 14 can include the electrical connector 202 mounted to the flat flex cable 22 as described above, and a complementary electrical device mated to the electrical connector 202 and having a processor that receives signals from the various sensors to determine if and/or at what force the air bags 16, 17 should be deployed. As seen best in FIG. 8, the flexible printed circuit 22 is provided in the general shape of a mat. The FPC mat 22 has a connection tail 28 with contact sections 30. Electrical conductors 32 extend through the FPC mat 22 and are covered by electrical insulation. The frame 24 is generally comprised of molded plastic. The frame 24 provides a support for the FPC mat 22. The frame 24 is located against a bottom side of the FPC mat 22. As shown in FIG. 11, the frame 24 comprises pairs of snap lock latches 34 which extend through holes in the FPC mat 22 such that the snap lock latches are located on the top side of the FPC mat. Each of the opposing pairs of snap lock latches 34 form a receiving area 36 therebetween on the top side of the FPC mat 22. As shown best in FIG. 9, the frame 24 comprises support sections 38 connected to each other by a support lattice section 40. The support sections 38 comprise a general flat disk shape. The snap lock latches 34 extend from a top side of the support sections 38. Thus, the support sections 38 provide a substantially flat surface 42 on the top side of the frame 24 between each of the pairs of snap lock latches 34.

Referring now particularly to FIG. 10, a portion of the frame 24 is shown with one of the Hall effect sensor assemblies 26 attached thereto. FIG. 10 shows the seat sensor device without showing the FPC mat 22 merely for the sake of clarity. The FPC mat 22 would be located between the flat surface 42 and the bottom side of the Hall effect sensor assembly 26. The FPC mat is essentially sandwiched between the bottom side of the sensor assembly 26 and the flat surface 42. The Hall effect sensor assembly 26 generally comprises a housing 44, a Hall effect sensor 46, a magnet 48, and a spring 50. In the embodiment shown, the seat sensor device 20 comprises sixteen of the Hall effect sensor assemblies 26 (see FIG. 8). However, in alternate embodiments, the seat sensor device could comprise more or less than sixteen Hall effect sensor assemblies. In addition, the Hall effect sensor assemblies could be positioned in any suitable type of array on the FPC mat 22.

Referring also to FIGS. 12-16, the housing 44 generally comprises a first housing member 52 and a second housing member 54. The first housing member 52 is preferably comprised of molded plastic or polymer material. As seen best in FIGS. 12 and 13, the first housing member 52 generally comprises a base section 56 and a general tube section 58. The base section 56 generally comprises an extension 60 having an open aperture 62, snap lock ledges 64, and a central spring cavity 66. The general tube section 58 extends in an upward direction from the top side of the base section 56 around the spring cavity 66. The general tube section 58 generally comprises two opposing curved columns 68. The two columns 68 defined a magnet movement path therebetween. More specifically, the two columns 68 define an area 70 which is adapted to receive the second housing member 54 which houses the magnet as further described below. In the embodiment shown, each of the columns 68 include an alignment slot 72 therein. The alignment slots 72 are used to movably attach the second housing member 54 to the first housing member 52 as further described below. The top sides of the alignment slots 72 are closed by transverse sections 74 of the columns.

Figure 13:
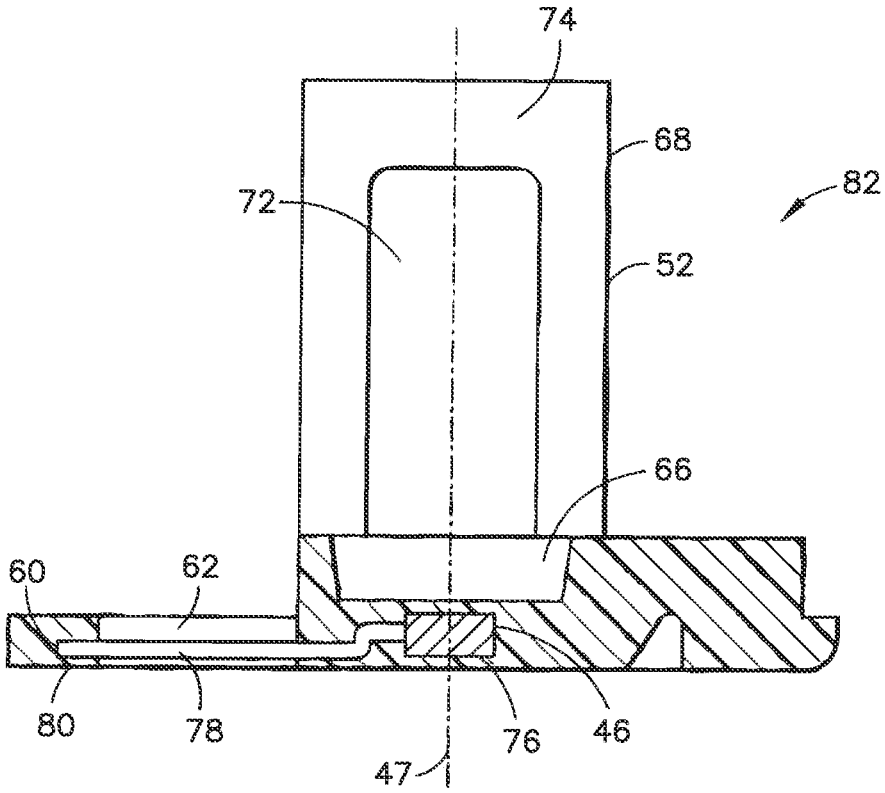
FIG. 13 is a cross sectional view of a first subassembly of the sensor assembly shown in FIG. 10 comprising the first housing member shown in FIG. 12 and a Hall effect sensor.
Figure 14:
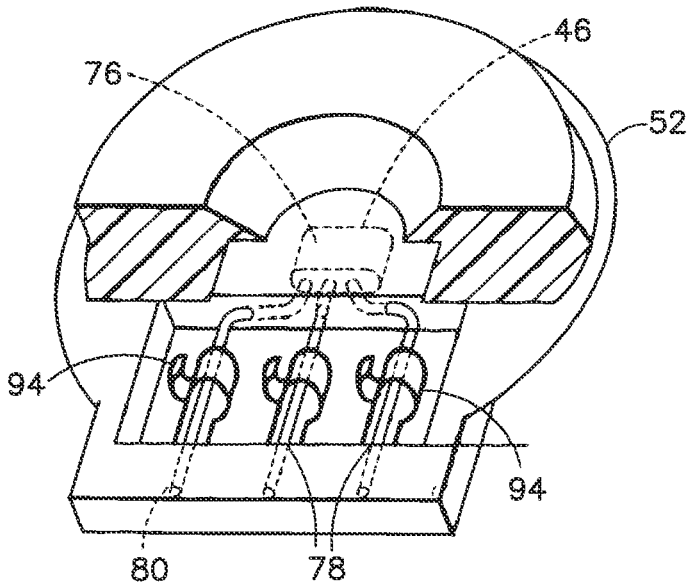
FIG. 14 is a perspective view of the first subassembly shown in FIG. 13 with a cutaway section.

Referring particularly to FIGS. 13 and 14, the Hall effect sensor 46 is housed, at least partially, inside the first housing member 52. Thus, the first housing member 52 and the Hall effect sensor 46 form a first subassembly 82. In a preferred embodiment of the present invention, the first housing member 52 comprises an overmolded housing which is overmolded over portions of the Hall effect sensor 46. The Hall effect sensor 46 generally comprises a sensing section 76 and three electrical leads 78. One lead is for power, one lead is for ground and one lead is for signals. In a preferred embodiment, the Hall effect sensor 46 is a range taking sensor capable of continuous signaling of distance of the magnet relative to the sensor 46. However, in alternate embodiments, the Hall effect sensor could be adapted to signal two or more range settings, such as by using a step capable sensor.

The three electrical leads 78 span across the open aperture 62 of the extension 60 in the first housing member 52 and, more specifically, the electrical leads 78 comprises exposed middle sections which do not have the overmolded housing member 52 thereon. The electrical leads 78 comprises distal ends 80 which are fixedly attached to the first housing member 52 by the overmolding process. The proximal end of the electrical leads 78 are also fixedly attached to the first housing member by the overmolding process. Thus, the first housing member 52 retains the exposed middle sections of the electrical leads in a fixed, spaced orientation relative to each other and a fixed orientation relative to the overmolded housing member 52.

Figure 15:
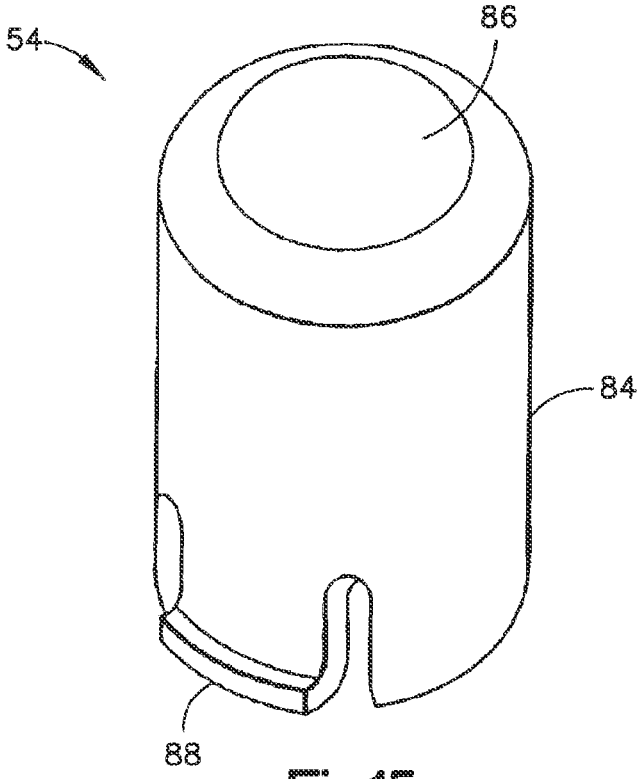
FIG. 15 is a perspective view of a second housing member used in the sensor assembly shown in FIG. 10.
Figure 16:
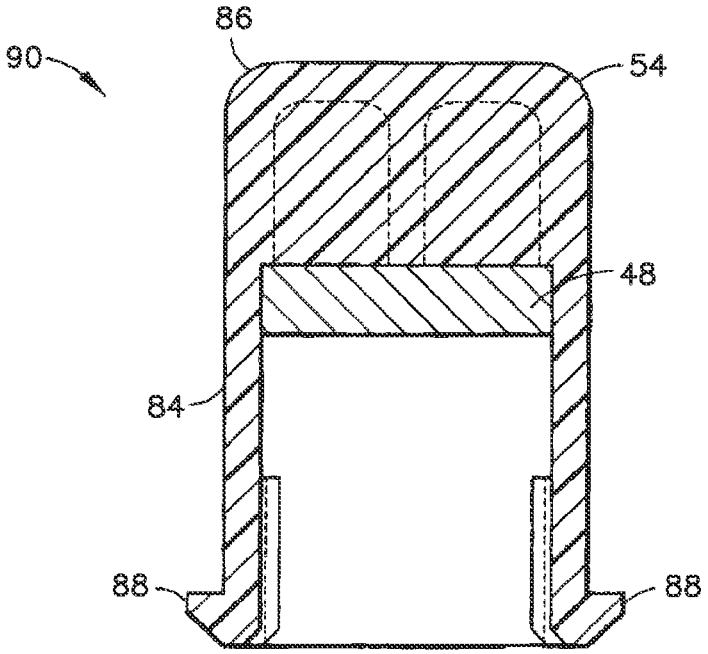
FIG. 16 is a cross sectional view of a second subassembly used in the sensor assembly shown in FIG. 10 comprising the second housing member shown in FIG. 15 and a permanent magnet.

Referring particularly to FIGS. 15 and 16, the second housing member 54 generally comprises a one-piece member preferably comprised of molded plastic or polymer material. The second housing member 54 generally comprises a tube shaped section 84, a top section 86 and snap lock latches 88 forming a bottom part of the tube shaped section 84. The magnet 48 is located inside the tube shaped section 84 against the bottom side of the top section 86. The magnet 84 is preferably press fit inserted into the second housing member. Thus, the second housing member 54 and magnet 48 form a second subassembly 90.

As seen in FIG. 10, the spring 50 is connected between the two subassemblies 82, 90. A first end of the spring 50 is located in the spring cavity 66 of the first housing member 52 (see FIG. 12) and a second opposite end of the spring is located inside the tube shaped section 84 of the second housing member 54. The second opposite end of the spring 50 is located directly against the bottom side of the magnet 48. The spring 50 biases the second subassembly 90 in an upward direction as shown in FIG. 10. In a preferred embodiment the spring is comprised of nonferrous material such that it does not impact the magnetic field.

In order to assemble the two subassemblies 82, 90 and spring 50 together, the spring is placed in the spring cavity 66 and the second subassembly 90 is inserted into the top of the first subassembly 82 as indicated by arrow 92 with the bottom of the second housing 54 entering into the area 70 between the two columns 68. The area 70 is sized and shaped to slidably received the second housing member 54 therein. As the second housing member 54 is inserted into the area 70, the snap lock latches 88 are resiliently deflected in an inward direction until the latches pass by the transverse sections 74 of the columns 68. The snap lock latches 88 are then able to deflect outward and into the two alignment slots 72. This provides a snap lock connection of the second housing member 54 to the first housing member 52.

Figure 17:
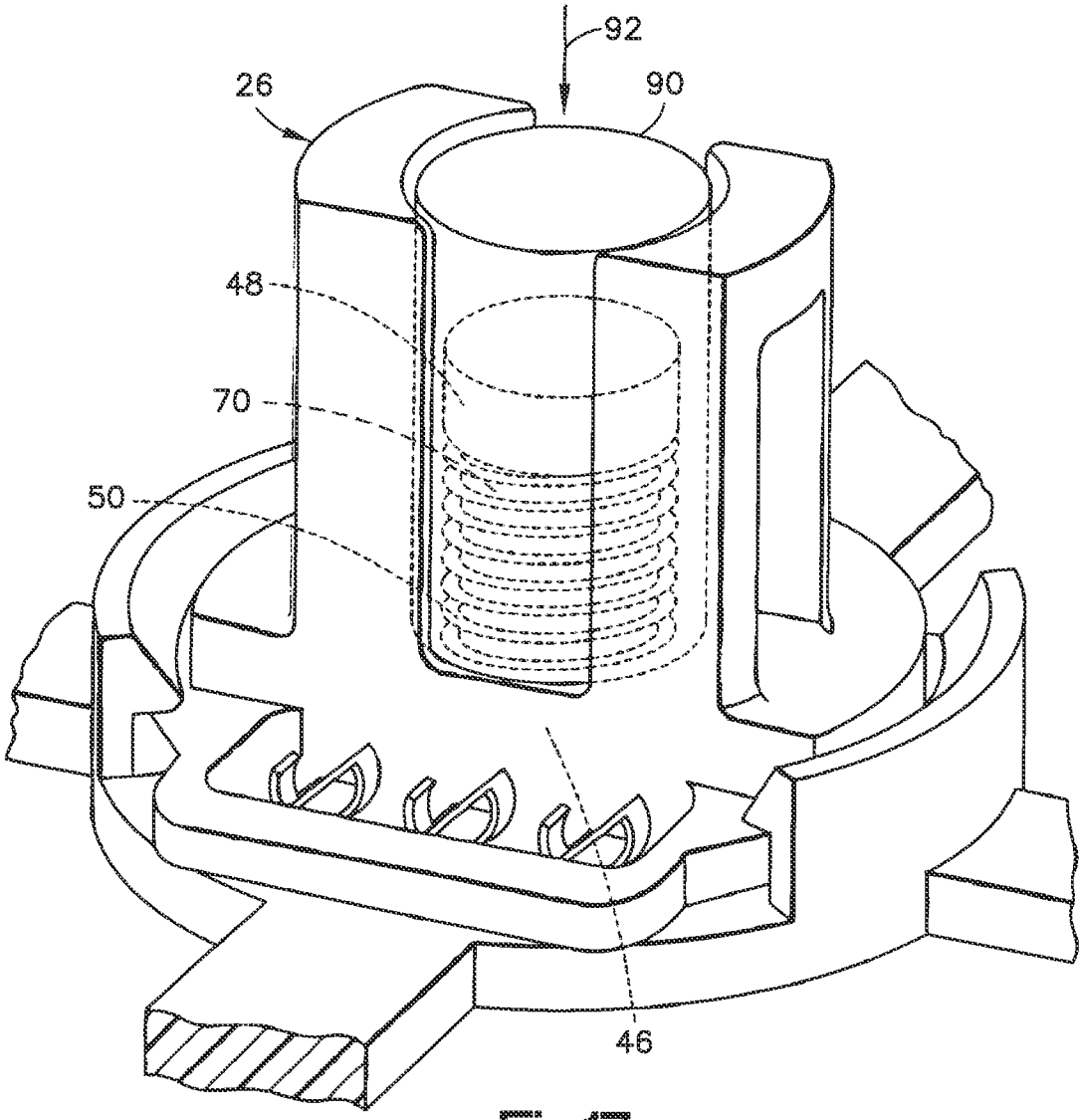
FIG. 17 is a perspective view as in FIG. 10 with the second subassembly moved towards a depressed position.

The snap lock connection merely prevents the second subassembly 90 from becoming disengaged from the first subassembly 82. However, the connection of the two subassemblies 82, 90 to each other provides a movable connection. More specifically, the outer portions of the snap lock latches 88 are adapted to vertically slide in the alignment slots 72. Referring also to FIG. 17, the Hall effect sensor assembly 26 is shown similar to that shown in FIG. 10, but in this configuration the second subassembly 90 has been depressed as indicated by arrow 92 in an inward direction; further into the area 70. This results in the spring 50 being resiliently compressed and the magnet 48 being moved closer to the Hall effect sensor 46. When force is reduced on the top surface of the second subassembly 90, the spring 50 can move the second subassembly and the magnet 48 in a direction away from the Hall effect sensor 46. With the present invention, the movably connection between the two housing members 52, 54 provides a telescoping type of movement which allows the magnet to move towards and away from the Hall effect sensor 46 along a Hall effect central sensing axis 47 (see FIG. 13). The movable connection is designed to prevent the magnet 48 from getting out of parallel with the Hall effect sensor 46 by more than ten degrees. In a preferred embodiment, the magnet might only be able to tilt or move out of alignment by 5-10 degrees.

Figure 18:
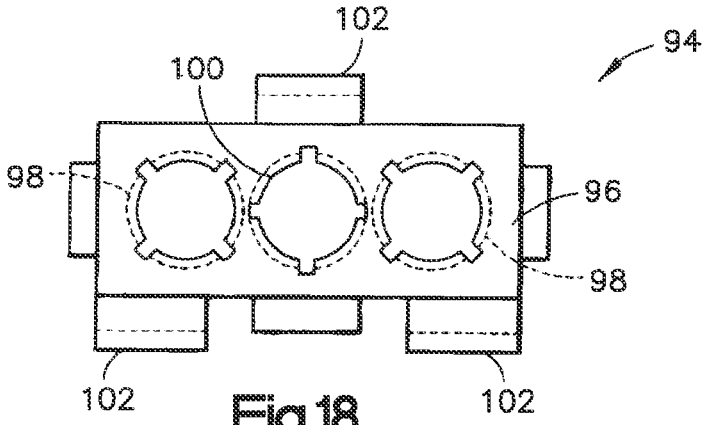
FIG. 18 is a top plan view of one of the terminals used to connect the sensor assembly shown in FIG. 10 to the flexible printed circuit mat.
Figure 19:
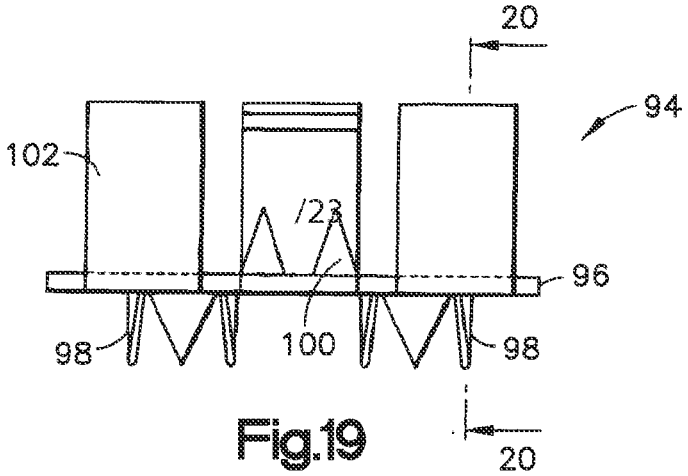
FIG. 19 is a side elevation view of the terminal shown in FIG. 18.
Figure 20:
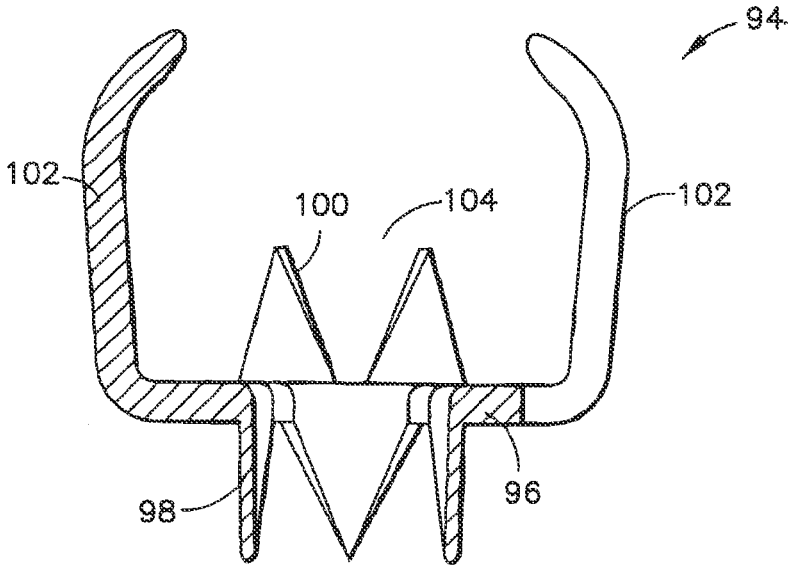
FIG. 20 is a cross sectional view of the terminal shown in FIG. 19 taken along line 20-20.

As seen best in FIGS. 11 and 14F, the seat sensor device 20 includes electrical terminals 94. More specifically, in the embodiment shown, three of the terminals 94 are provided at each of the sensor assemblies 26; one terminal for each one of the electrical leads 78 of the Hall effect sensor 46. Referring also to FIGS. 18-20, one of the terminals 94 is shown. Each terminal 94 generally comprises a one-piece electrically conductive member. In a preferred embodiment, the terminal 94 is comprised of flat sheet metal which has been stamped into the shape shown. The terminal 94 generally comprises a center section 96, bottom extending sections 98, a top extending section 100, and upward extending side sections 102.

The terminals 94 are fixedly attached to the FPC mat 22 before the sensor assemblies 26 are connected. More specifically, the terminals 94 are pressed against the top surface of the FPC mat 22 with the bottom extending sections 98 piercing through the mat and being deformed outward and upward to form a mechanical and electrical connection with individual ones of the electrical conductors 32 in the mat. When the sensor assemblies 26 are being connected to the FPC mat 22 and the snap lock latches 34 of the frame 24, the terminals 94 are received in the open aperture 62 of the extension 60 through the bottom of the first housing member 52. The electrical leads 78 of the Hall effect sensors 46 are each positioned into the area 104 between the side sections 102 of one of the terminals.

The side sections 102 are then deformed inward towards the area 104 to clamp the middle exposed sections of the electrical leads 78 into a mechanical and electrical connection with the top extending section 100 and side sections 102 against the top side of the center section 96. If the electrical leads 78 comprise electrical insulation, the relatively sharp edges on the top extending section 100 is adapted to cut through the electrical insulation to insurer electrical contact between the terminal 94 and the electrical conductor of the electrical lead 78. However, in alternate embodiments, any suitable type of terminal or method of electrically connecting the electrical leads 78 to the electrical conductors 32 of the FPC mat 22 could be provided. However, in the embodiment shown, the terminals 94 are adapted to allow the side sections 102 to be moved to an open position again to allow the sensor assembly 26 to be removed from connection with the terminals. A replacement sensor assembly can be connected to the FPC mat to replace a broken or faulty original sensor assembly 26. Thus, in a preferred embodiment, the electrical connection of the sensor assembly 26 to the conductors in the FPC mat is preferably a removable connection. In an alternate embodiment, the electrical connection might not comprise a removable connection.

Referring back to FIG. 10, the sensor assembly 26 is attached to the frame 24 by inserting the base section 56 through the top side of an opposing pair of the snap lock latches 34. The snap lock ledges 64 (see FIG. 12) of the first housing member 52 snap beneath portions of the snap lock latches 34. The present invention, unlike conventional designs, does not need a separate lock to attach the frame to the FPC mat. With the present invention, the first housing member 52 functions as the lock to attach the FPC mat to the frame 24. The use of the first housing member 52 as the lock allows the seat sensor device 20 to be manufactured with less components. The assembly of the seat sensor device 20 comprises less steps and is therefore quicker to assemble.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector configured to mount to a flex cable, the electrical connector comprising:

a dielectric connector housing;

at least one electrical terminal supported by the connector housing, the at least one electrical terminal defining a mating portion and a mounting portion, the mounting portion including first and second crimp members spaced from each other along a length of the at least one electrical terminal, each of the first and second crimp members including plurality of crimp teeth configured to pierce through a flex cable when crimped so as to mount the flex cable to the mounting portion, wherein one of the first and second crimp members of the at least one electrical terminal has a different number of crimp teeth than the other of the first and second crimp members.

2. The electrical connector as recited in claim 1, wherein the crimp teeth of the first crimp member are disposed about a first perimeter and the crimp teeth of the second crimp member are disposed about a second perimeter that is different than the first perimeter.

3. The electrical connector as recited in claim 2, wherein the second perimeter is discontinuous with the first perimeter.

4. The electrical connector as recited in claim 2, wherein the first and second perimeters are disposed about respective different apertures that extend through the mounting portion.

5. The electrical connector of claim 1, wherein an outer one of the first and second crimp members has fewer teeth than an inner one of the first and second crimp members of the select plurality of the first and second electrical terminals.

6. The electrical connector as recited in claim 5, wherein the outer one of the first and second crimp members is rearwardly spaced from the inner one of the first and second crimp members.

7. The electrical connector as recited in claim 1, wherein the at least one electrical terminal is a first electrical terminal, the electrical connector further comprises a second electrical terminal supported by the connector housing, and the second electrical terminal defines a mating portion and a mounting portion, the mounting portion including first and second crimp members spaced from each other along a length of the at least one electrical terminal, each of the first and second crimp members including plurality of crimp teeth configured to pierce through the flex cable when crimped so as to mount the flex cable to the mounting portion.

8. The electrical connector as recited in claim 7, wherein the first and second crimp members of at the second electrical terminal have an equal number of crimp teeth.

9. The electrical connector as recited in claim 7, wherein the first and second electrical terminals are alternatingly arranged along the connector housing along a longitudinal direction.

10. The electrical connector as recited in claim 7, wherein the first crimp member of the first electrical terminal is not aligned with the first crimp member of the second electrical terminal along the longitudinal direction, and the first crimp member of the first electrical terminal is not aligned with the second crimp member of the second electrical terminal along the longitudinal direction.

11. An electrical connector comprising:

a dielectric connector housing;

at least one first electrical terminal supported by the connector housing and at least one second electrical terminal supported by the connector housing at a location spaced from the at least one first electrical terminal along a longitudinal direction, each of the first and second electrical terminals defining respective mating portion and a mounting portion spaced from the mating portion along a transverse direction that is substantially perpendicular to the longitudinal direction, the mounting portion including first and second crimp members spaced from each other along a lateral direction that is substantially perpendicular to the longitudinal and transverse directions, each of the first and second crimp members having a plurality of crimp teeth configured to pierce through a flex cable when crimped so as to mount the flex cable to the mounting portion of the electrical terminal, wherein the crimp members of the first electrical terminals are offset with respect to the crimp members of the second electrical terminals along the lateral direction.

12. The electrical connector as recited in claim 11, wherein the crimp teeth of the first crimp members are disposed about respective first perimeters, and the crimp teeth of the second crimp members are disposed about respective second perimeters that are different than the first perimeters.

13. The electrical connector as recited in claim 12, wherein the second perimeters are discontinuous with the first perimeters.

14. The electrical connector as recited in claim 12, wherein the first and second perimeters are disposed about respective different apertures that extend through the respective mounting portions.

15. An electrical terminal comprising a mating portion and a mounting portion, the mounting portion including first and second crimp members spaced from each other along a length of the electrical terminal, each of the first and second crimp members including plurality of crimp teeth configured to pierce through a flex cable when crimped so as to mount the flex cable to the mounting portion, wherein one of the first and second crimp members have a different number of crimp teeth than the other of the first and second crimp members.

16. The electrical connector as recited in claim 15, wherein the crimp teeth of the first crimp member are disposed about a first perimeter and the crimp teeth of the second crimp member are disposed about a second perimeter that is different than the first perimeter.

17. The electrical connector as recited in claim 16, wherein the second perimeter is discontinuous with the first perimeter.

18. The electrical connector as recited in claim 16, wherein the first and second perimeters are disposed about respective different apertures that extend through the mounting portion.

19. The electrical connector of claim 15, wherein an outer one of the first and second crimp members has fewer teeth than an inner one of the first and second crimp members of the select plurality of the first and second electrical terminals.

* * * * *